US008205962B2

(12) United States Patent
Yoshimura

(10) Patent No.: US 8,205,962 B2
(45) Date of Patent: Jun. 26, 2012

(54) INKJET PRINTHEAD FOR USE IN IMAGE FORMING APPARATUS

(75) Inventor: Kenichi Yoshimura, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 386 days.

(21) Appl. No.: 12/496,828

(22) Filed: Jul. 2, 2009

(65) Prior Publication Data

US 2010/0002051 A1 Jan. 7, 2010

(30) Foreign Application Priority Data

Jul. 4, 2008 (JP) ..... 2008-175610
Feb. 3, 2009 (JP) ..... 2009-022620

(51) Int. Cl.
*B41J 2/16* (2006.01)

(52) U.S. Cl. ..... 347/40; 347/71

(58) Field of Classification Search ..... 347/40, 347/42, 49, 68, 71
See application file for complete search history.

(56) References Cited

U.S. PATENT DOCUMENTS 5,782,184 A * 7/1998 Albertalli et al. ..... 101/486
6,068,367 A * 5/2000 Fabbri ..... 347/49
6,467,874 B1 * 10/2002 Williams et al. ..... 347/42
7,665,815 B2 * 2/2010 Swett et al. ..... 347/9

FOREIGN PATENT DOCUMENTS

JP 10-95114 4/1998
JP 2001-96734 4/2001
JP 2005-144933 6/2005

OTHER PUBLICATIONS

Machine-generated translation of JP 2001-096734, published on Apr. 2001.*
Machine-generated translation of JP 10-095114, published on Apr. 1998.*

* cited by examiner

*Primary Examiner* — Huan Tran
(74) *Attorney, Agent, or Firm* — Cooper & Dunham LLP

(57) ABSTRACT

An inkjet printhead includes multiple head modules and a mount base. The multiple head modules each includes a laminate unit containing a nozzle to eject ink in droplets and an ink chamber in fluid communication with the nozzle. The multiple head modules are mounted on the mount base. The mount base defines a first contact surface facing a first direction in which the ink is ejected. Each laminate unit defines a second contact surface facing a second direction opposite to the first direction. The first and second contact surfaces are held in contact with each other to position each head module in the mount base.

8 Claims, 21 Drawing Sheets

INKJET PRINTHEAD FOR USE IN IMAGE FORMING APPARATUS

CROSS-REFERENCE TO RELATED APPLICATIONS

The present patent application claims priority pursuant to 35 U.S.C. §119 from Japanese Patent Application Nos. 2008-175610, filed on Jul. 4, 2008, and 2009-022620, filed on Feb. 3, 2009, respectively, which are hereby incorporated by reference herein in their entirety.

BACKGROUND OF THE INVENTION

1. Field of the Invention

The present invention relates to an inkjet printhead, and more particularly, to an inkjet printhead for use in an image forming apparatus that forms images by ejecting droplets of ink from multiple nozzles onto a recording medium.

2. Discussion of the Background

Inkjet printing technologies are employed in many image forming apparatuses, such as printers, facsimiles, photocopiers, plotters, and multifunctional machines incorporating several of these capabilities. In general, an inkjet printer employs a fluid-ejecting device called a printhead that forms images by ejecting droplets of liquid ink from multiple nozzles onto recording media, such as paper, transparency film, etc., passing through a print zone.

Typically, an inkjet printhead contains an array of multiple nozzles in fluid communication with channels or chambers holding ink, and an actuator that pressurizes the ink chambers to expel ink in droplets from the corresponding nozzles. To date, inkjet printheads are manufactured with various configurations of nozzle arrays and/or actuators for various types of inkjet printers. For example, a movable printhead with a relatively short array of nozzles is employed in serial inkjet printers, which print images while moving back and forth along a scanning axis to traverse the width of the print zone. By contrast, a stationary printhead with an elongated nozzle array (in particular, one spanning the width of the print zone) is designed for line inkjet printers, which can perform printing without reciprocating movement along the scanning axis. Different types of printheads are constructed with different types of actuators, such as piezo-actuators formed of piezoelectric elements, thermal actuators using resistive heaters, electrostatic actuators that work by generating electrostatic forces, etc.

In most inkjet printers, a printhead is composed of multiple identical head modules each having chambers for holding ink, a driver or actuator for pressurizing the ink chambers, and a nozzle plate defining an array of nozzles, all manufactured with high precision and integrated into a single precision assembly. These head modules are mounted on a single mount base or carriage, with the nozzle plates forming a nozzle face in a particular arrangement according to the type (e.g., serial or line) of the printer into which the printhead is incorporated. Such modular design allows for repairing defective modules without requiring replacement of the entire printhead, and facilitates manufacture of a wide-array printhead for full-line inkjet printers that can perform printing at extremely high speed.

What is essential for good performance of such a modular printhead is the precision with which the multiple head modules are assembled into a single unit. This includes horizontal accuracy in positioning each head module with respect to one another in the horizontal plane, as well as vertical accuracy in positioning each head module on the mount base so that the printhead installed in a printer has its nozzle face at a consistent distance close to a recording medium passing throughout the print zone. For example, today's inkjet printers require a horizontal accuracy of within ±10 μm in terms of the amount of deviation from perfect alignment between nozzle arrays, and a consistent vertical gap of within 1 mm or smaller between the nozzle face and the recording medium for high definition inkjet printing.

Various construction techniques have been proposed to provide a modular printhead assembly with the required high horizontal and vertical positioning accuracies.

For example, one conventional technique provides a printhead constructed with multiple head modules, each having a nozzle plate and a substrate connected together, mounted on a single carriage having multiple sets of standard level surfaces (hereinafter "datum surfaces") defined therein. Each head module has a positioning member defined in the substrate, and is positioned along x-, y-, and z-axes in the carriage by contacting the positioning member with the corresponding datum surfaces.

This method is designed to arrange the multiple head modules in line on the single carriage, but fails to ensure precise alignment of the nozzle arrays and good positioning of the nozzle face. That is, providing the positioning member on the substrate but not on the nozzle plate cannot compensate for variations in the connection between the substrate and the nozzle plate, resulting in misalignment of the nozzle arrays along the horizontal x- and y-axes. Further, dimensional variations inherent both in the positioning members and the datum surfaces affect positioning of the nozzle plates along the vertical axis, resulting in an inconsistent gap between the nozzle face and the recording medium.

Another conventional technique provides a printhead assembly having multiple replaceable head modules staggered on a mount base extending parallel to the width of a print zone, in which each head module has a set of positioning holes defined in the nozzle plate for engagement with a set of positioning pins disposed in the mount base. Each nozzle plate is positioned in a horizontal plane by engaging the positioning holes with the positioning pins, and in a vertical direction with a screw-fixed cover plate covering the surface of the mount base except for the nozzle arrays while securing edges of the nozzle plates against the mount base.

This method provides proper positioning of the nozzle plates in the horizontal plane by engaging the positioning pins and holes, effecting good alignment between the multiple nozzle arrays. However, using the cover plate for securing the nozzle plates in place results in certain drawbacks. Firstly, interposing the cover plate, which has a sufficient thickness to withstand mechanical stress, between the nozzle face and the recording medium increases the distance between the nozzle face and the recording medium in the print zone. Moreover, securing the multiple nozzle plates with the single cover plate results in poor maintainability of the printhead since replacement of even a single defective module requires demounting of the entire printhead unit for removing the screw-fixed cover plate.

Still another conventional technique proposes a printhead assembly with multiple head modules precisely positioned in a carriage using image data processing. According to this method, each head module has a nozzle plate with a set of alignment marks defined thereon, and a frame with an adjustment lever projecting therefrom for adjusting the position of the head module in the carriage. The assembly process includes vertically positioning the head module by engaging the adjustment lever with a holder disposed on the carriage, and adjusting the horizontal position of the nozzle plate to match a reference plane based on the position of the alignment marks detected and processed by imaging equipment.

This method enables precise alignment of multiple nozzle arrays in the horizontal plane using image data processing, but is insufficient where the vertical positioning is affected by an accumulation of variations in engaging the adjustment lever and the carriage holder. Also, this method has a drawback in that positioning the head modules using imaging equipment makes it impossible or impractical for a user to replace a defective nozzle module in the printhead assembly once it is installed.

Hence, what is required is a printhead assembly with a simple but high-precision positioning mechanism for use in an inkjet printer, which can properly position multiple head modules and nozzle arrays not only in a horizontal plane but also vertically to produce a consistent narrow gap between the nozzle face and the recording medium.

SUMMARY OF THE INVENTION

Exemplary aspects of the present invention are put forward in view of the above-described circumstances, and provide a novel inkjet printhead for use in an image forming apparatus which forms images by ejecting droplets of ink from multiple nozzles.

In one exemplary embodiment, the novel inkjet printhead includes multiple head modules and a mount base. The multiple head modules each includes a laminate unit containing a nozzle to eject ink in droplets and an ink chamber in fluid communication with the nozzle. The multiple head modules are mounted on the mount base. The mount base defines a first contact surface facing a first direction in which the ink is ejected. Each laminate unit defines a second contact surface facing a second direction opposite to the first direction. The first and second contact surfaces are held in contact with each other to position each head module in the mount base.

In one exemplary embodiment, the novel inkjet printhead includes multiple head modules and a mount base. The multiple head modules each includes a laminate unit containing a nozzle to eject ink in droplets and an ink chamber in fluid communication with the nozzle. The multiple head modules are mounted on the mount base. The mount base defines a first contact surface facing a first direction in which the ink is ejected. Each laminate unit has a flat positioning member combined therewith to define a second contact surface facing a second direction opposite to the first direction. The first and second contact surfaces are held in contact with each other to position each head module in the mount base.

In one exemplary embodiment, the novel inkjet printhead includes multiple head modules and a mount base. The multiple head modules each includes a laminate unit containing a nozzle to eject ink in droplets and an ink chamber in fluid communication with the nozzle. The multiple head modules are mounted on the mount base. The mount base defines a first contact surface facing a first direction in which the ink is ejected. Each laminate unit has an intermediate positioning layer inserted therein to define a second contact surface facing a second direction opposite to the first direction. The first and second contact surfaces are held in contact with each other to position each head module in the mount base.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
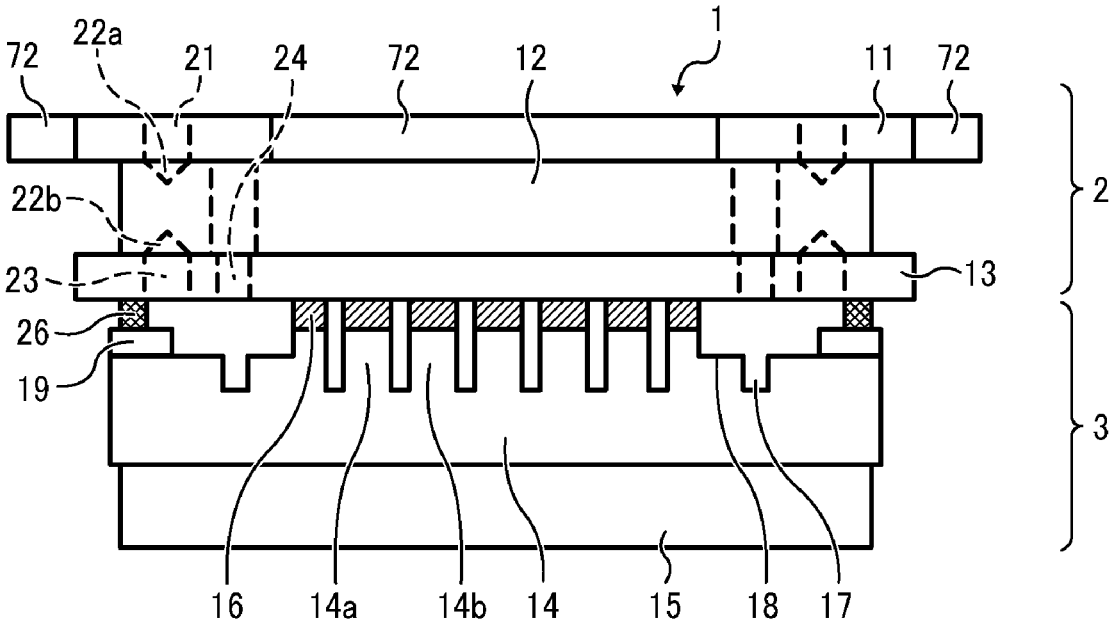
FIG. 1 is a side-elevational view schematically illustrating a head module incorporated in an inkjet printhead according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In the following discussion, the term "image" includes any visual representation of objects, including text, graphics, pictures, design, and artwork, either concrete or abstract, and the terms "image formation", "imaging", and "printing" refer to production of images on recording media, including, but not limited to, paper, thread, yarn, textiles, leather, metal, plastic, glass, wood, ceramic, etc. The term "image forming apparatus" used herein refers to any system capable of producing images as set forth herein, particularly to those that perform image formation by ejecting droplets of ink onto recording media, and the term "ink" is not limited to conventional inks, but includes any material that forms liquid droplets when ejected into air, such as deoxyribonucleic acid (DNA) samples for genome analysis, photoresist for photolithography or patterning, etc.

Referring now to the drawings, wherein like reference numerals designate identical or corresponding parts throughout the several views, examples and exemplary embodiments of this disclosure are described.

FIG. 1 is a side-elevational view schematically illustrating a head module 1 incorporated in an inkjet printhead P0, not shown, according to one embodiment of this patent specification.

As shown in FIG. 1, the head module 1 is a piezoelectric liquid ejector module including a laminate chamber unit 2 and a piezoelectric driver unit 3 combined together. As will be described hereinbelow, the chamber unit 2 and the driver unit 3 are integrally held in a frame 4, not shown, for mounting on the printhead P0 which may have one or more head modules 1 arranged in a particular configuration.

In the head module 1, the chamber unit 2 includes a nozzle plate 11, a channel plate 12, and a vibratory plate 13, stacked in tiers to form a laminate structure internally defining fluid paths and chambers allowing ink to flow therethrough. The internal structure of the chamber unit 2 is detailed with reference to FIGS. 2 and 3, which are plan views schematically illustrating the nozzle plate 11 and the channel plate 12, respectively, before assembly.

Figure 2:
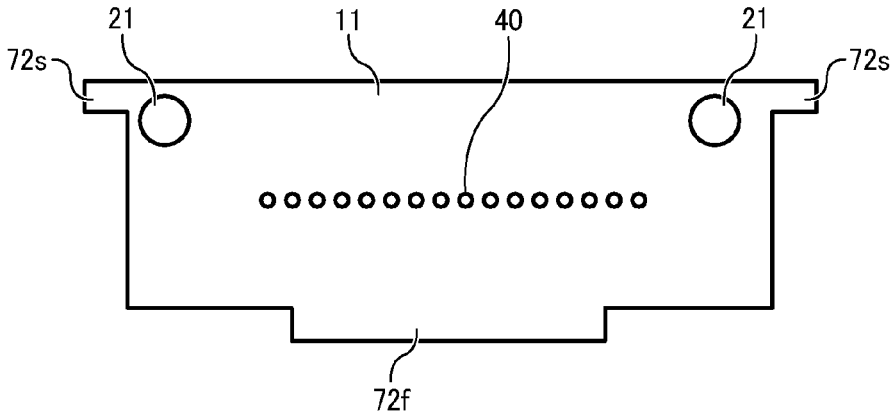
FIG. 2 is a plan view schematically illustrating a nozzle plate included in the head module of FIG. 1 before assembly.
Figure 3:
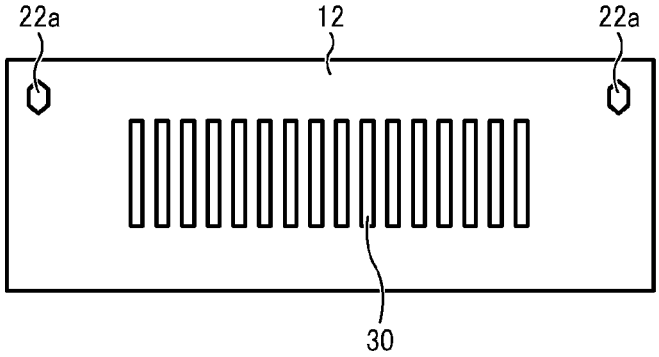
FIG. 3 is a plan view schematically illustrating a channel plate included in the head module of FIG. 1 before assembly.

As shown in FIG. 2, the nozzle plate 11 defines an array of multiple nozzles 40 for ejecting ink in droplets. Correspondingly, the channel plate 12 defines multiple ink chambers 30 for holding ink as shown in FIG. 3, which are walled at least partially with the vibratory plate 13 and establish fluid communication with the multiple nozzles 40 in the assembled chamber unit 2.

With further reference to FIG. 2, the nozzle plate 11 according to the present embodiment is configured to have a front rib 72*f* projecting from a longitudinal edge parallel to the array of nozzles 40 and a pair of side ribs 72*s* projecting from opposing edges perpendicular to the longitudinal edge. The nozzle plate 11 in such a configuration forms part of a mechanism to position the head module 1 in the printhead P0 as will be detailed below.

In the chamber unit 2, the nozzle plate 11 has a pair of through-holes 21 on opposing sides thereof corresponding to a pair of alignment marks 22*a* on opposing sides of the channel plate 12 for alignment purposes. Similarly, the vibratory plate 13 has a pair of through-holes 23 on opposing sides thereof corresponding to a pair of alignment marks 22*b* on opposing sides of the channel plate 12 for alignment purposes.

The driver unit 3 includes a pair of multilayer piezoelectric elements 14 (e.g., actuators formed of 10 or more piezoelectric layers) arranged parallel to each other and bonded to a substrate 15 with an adhesive, of which only one is shown in the side view. Each piezoelectric element 14 has active portions 14*a* and intermediate passive support portions 14*b* alternating and separate from each other, formed by slitting or die-cutting a piezoelectric material with a dicing saw or through other suitable fabrication processes.

The chamber unit 2 and the driver unit 3 are bonded by an adhesive layer 16 securing upper surfaces of the piezoelectric portions 14*a* and 14*b* to the vibratory plate 13, and the nozzle plate 11, the channel plate 12, and the vibratory plate 13 in the chamber unit 2 are bonded together with an adhesive applied to upper and lower surfaces of the middle channel plate 12.

In use, the head module 1 is mounted in the printhead P0 with the chamber unit 2 down and the driver unit 3 up so that the nozzle plate 11 faces a recording medium passing below the printhead P0 in a print zone. The chamber unit 2 is supplied with ink from a suitable ink source, not shown, and holds ink in the ink chambers 30 for supplying the corresponding nozzles 40. To print an image, the driver unit 3 selectively drives the active portions 14*a* with electronic pulses, while the support portions 14*b*, remaining non-pulsed, support the chamber unit 2 in place. This causes the active portions 14*a* to pressurize the ink chambers 30, which in turn activate the corresponding nozzles 40 to expel droplets of ink downward onto the recording medium to form an image thereon.

For the printhead P0 to perform printing with good imaging quality, it is important that the printhead P0 have multiple head modules 1 each formed with high dimensional accuracy and properly positioned with respect to each other, forming the nozzle face at a consistent distance close to the recording medium in the print zone. For this purpose, the head module 1 according to this patent specification has its components, particularly the nozzle plate 11, the channel plate 12, and the vibratory plate 13 forming the chamber unit 2, each machined with extremely high dimensional accuracy, and accurately positioned with respect to each other when assembled into a single unit. In particular, the constituent layers of the chamber unit 2 are positioned relative to each other to an accuracy of ±1 μm or better using a precision alignment technique based on image processing described as follows.

Figure 4:
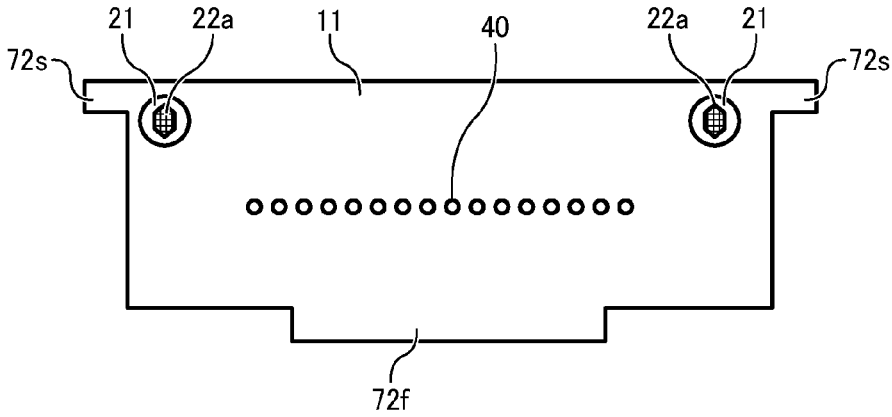
FIG. 4 is a plan view schematically illustrating the nozzle plate aligned with the channel plate.

FIG. 4 is a plan view schematically illustrating the nozzle plate 11 aligned with the channel plate 12 in the chamber unit 2. As shown in FIG. 4, during assembly, the nozzle plate 11 is placed above the channel plate 12 so that the alignment marks 22*a* of the channel plate 12 are visible through the through-holes 21 on the upper side of the nozzle plate 11. Then, digital image processing is performed using imaging equipment to determine a pair of imaginary reference points, one midway between the through-holes 21 and the other midway between the alignment marks 22*a*, as well as a pair of imaginary reference lines, one connecting the through-holes 21 and the other connecting the alignment marks 22*a*. The channel plate 12 is registered relative to the nozzle plate 11 so as to reduce the distance between the reference points and the angle formed by the reference lines to specified acceptable values.

The nozzle plate 11 and the channel plate 12 after positioning are forced against each other and bonded together with a suitable temporary bond such as an ultraviolet (UV) curable adhesive.

Also, the vibratory plate 13 is stacked on the channel plate 12 so that the alignment marks 22*b* of the channel plate 12 are visible through the through-holes 23 on the upper side of the vibratory plate 13. Then, digital image processing is performed to register the channel plate 12 relative to the vibratory plate 13 so as to reduce the displacement between the alignment marks 22*b* and the through-holes 23 in the manner described above, followed by bonding the plates 12 and 13 with a suitable temporary bond.

After positioning the nozzle plate 11, the channel plate 12, and the vibratory plate 13 relative to each other, the chamber unit 2 is completed by bonding the constituent layers 11, 12, and 13 with a permanent adhesive.

When the chamber unit 2 and the driver unit 3 are obtained, these sub-assemblies are integrated into a single head module 1. This involves positioning the chamber unit 2 and the driver unit 3 relative to each other by aligning a pair of through-holes 24 on opposing sides of the vibratory plate 13 with a pair of alignment grooves 17 on recessed portions 18 of the piezoelectric element 14 and subsequently depositing a temporary bond 26 on raised edges 19 of the piezoelectric element 14 for holding the vibratory plate 13 thereto, followed by permanently bonding the chamber unit 2 and the driver unit 3 with the adhesive layer 16 applied between the vibratory plate 13 and the piezoelectric element 14.

Figure 5:
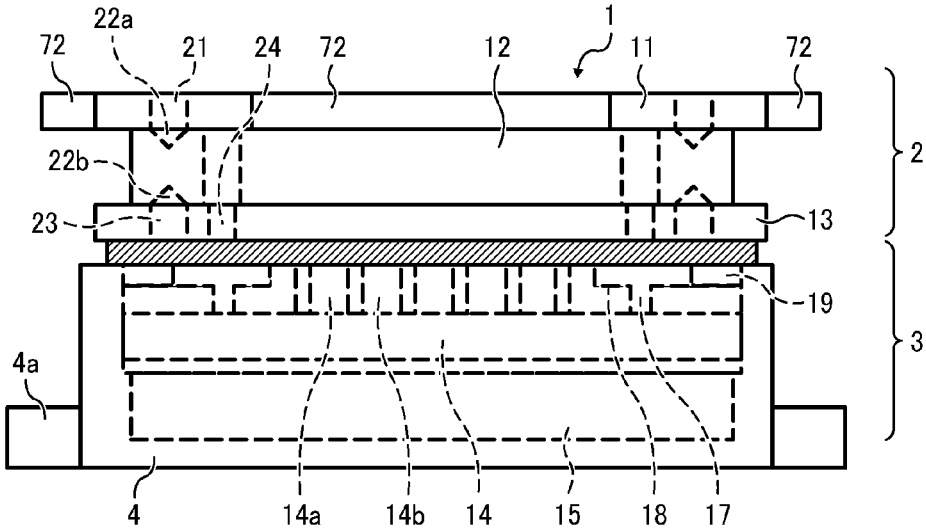
FIG. 5 is a side-elevational view schematically illustrating the head module of FIG. 1 after completion.

Thereafter, the integrated head module 1 is fitted into the frame 4 for completion. Fitting the head module 1 into the frame 4 involves positioning the head module 1 relative to the frame 4, inserting and pressing the driver unit 3 into the frame 4, applying an ultraviolet (UV) curable adhesive to contact surfaces, and curing the adhesive under exposure to UV light. As shown in FIG. 5, which is a side-elevational view schematically illustrating the head module 1 after completion, the frame 4 has a pair of horizontal extensions 4*a* on opposing sides for supporting the head module 1 in place on the printhead P0 as will be described hereinbelow. The head module 1 thus completed with the frame 4 is ready for mounting on the printhead P0.

Figure 6:
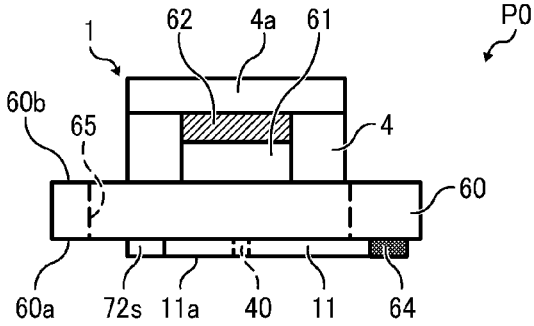
FIGS. 6 through 8 are side-elevational, front elevational, and bottom-plan views, respectively, schematically illustrating the printhead with the head module of FIG. 5 mounted thereon.
Figure 7:
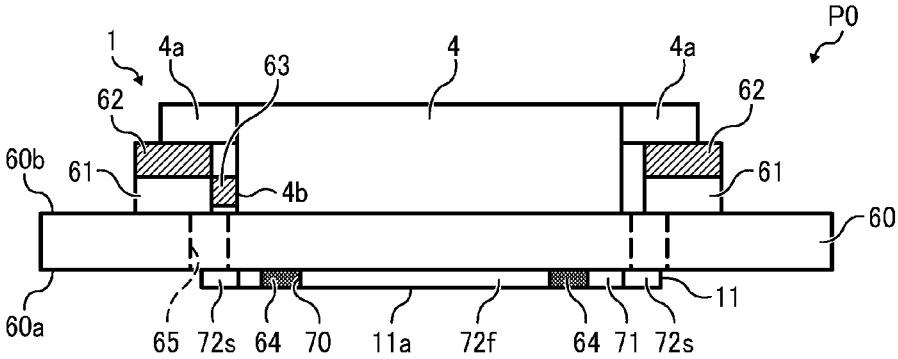
Figure 8:
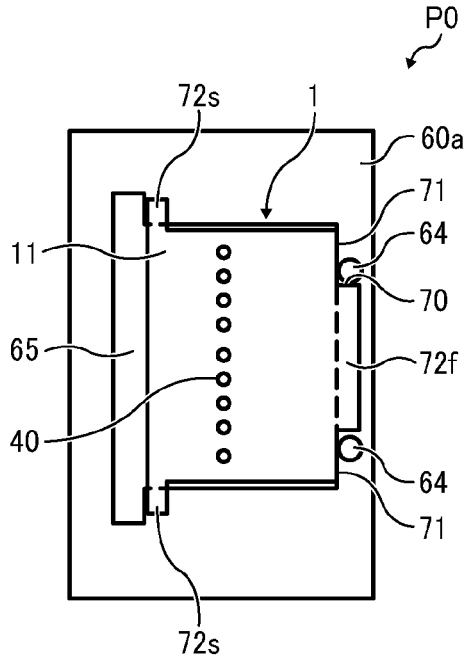

FIGS. 6 through 8 are side-elevational, front elevational, and bottom-plan views, respectively, schematically illustrating the printhead P0 with the head module 1 of FIG. 5 mounted thereon.

As shown in FIGS. 6 through 8, the head module 1 is inserted into a mount base 60 with the nozzle plate 11 down so as to locate a nozzle face 11*a* at the bottom of the printhead assembly P0. The mount base 60 has a bottom positioning surface 60*a* (e.g., "first contact surface") facing downward (i.e., in the direction in which the printhead P0 ejects ink) and a top surface 60*b* opposite the bottom surface 60*a*, holding the head module 1 with an upper surface of the nozzle plate 11 (i.e., the surface opposite the nozzle face 11*a*) contacting the positioning surface 60*a* of the mount base 60.

Specifically, the mount base 60 has an opening 65 shaped to accommodate the lateral dimensions of the nozzle plate 11, a pair of support blocks 61 on the top surface 60*b*, and a pair of reference pins 64 on the bottom surface 60*a* beside a longitudinal edge of the opening 65. The front and side contact ribs 72*f* and 72*s* of the nozzle plate 11 (e.g., "second contact surface") contact the positioning surface 60*a* of the mount base 60 around the opening 65, and two perpendicular edges 70 and 71 of the nozzle plate 11 contact one of the reference pins 64 of the mount base 60.

Further, the printhead assembly P0 also has a pair of first springs (e.g., leaf springs) 62 disposed between the horizontal extensions 4*a* of the frame 4 and the support blocks 61 of the mount base 60 on both side, and a second spring (e.g., leaf springs) 63 disposed between a side 4*b* of the frame 4 and the support block 61 on the corresponding side. The first springs 62 vertically urging the extensions 4*a* away from the top surface of the base 60 ensure secure contact between the surface of the nozzle plate 11 (i.e. "second contact surface") and the bottom surface 60*a* (i.e. "first contact surface") of the mount base 60. Similarly, the second spring 63 laterally urging the side 4*b* of the frame 4 ensures secure contact between the edge 70 of the nozzle plate 11 and the reference pin 64 of the mount base 60.

Figure 9:
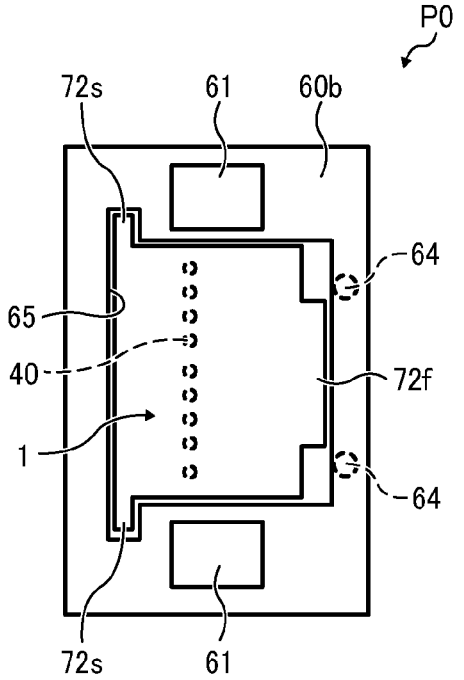
FIGS. 9 and 10 schematically illustrate mounting of the head module of FIG. 5 on a mount base viewed from above.
Figure 10:
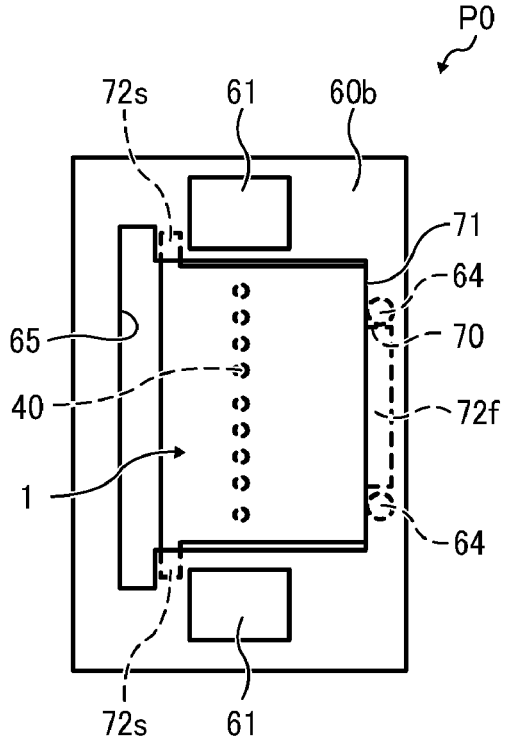

FIGS. 9 and 10 schematically illustrate mounting of the head module 1 on the mount base 60 viewed from above, with components of the head module 1 other than the nozzle plate 11 being removed for clarity.

As shown in FIG. 9, the head module 1 is inserted through the opening 65 of the base 60 with the nozzle face 11*a* down until the contact ribs 72 of the nozzle plate 11 reach below the bottom surface 60*a* of the base 60. Although not visible in the drawing, at this point, the head module 1 has the horizontal extensions 4*a* of the frame 4 resting on the support blocks 61 of the base 60.

After insertion, the head module 1 is slid sideways until the perpendicular edges 70 and 71 of the nozzle plate 11 contact the reference pin 64 as shown in FIG. 10. Then, the first springs 62 are inserted between the extensions 4*a* and the support blocks 61, and the second spring 63 is inserted between the side 4*b* of the frame 4 and the support block 61 on the corresponding side, causing the contact ribs 72*f* and 72*s* to reliably contact the bottom surface 60*a* of the base 60, and the reference edges 70 and 71 to reliably contact the reference pin 64 of the base 60. Subsequently, the extensions 4*a* of the frame 4 are fastened (e.g., with screws) to the corresponding support blocks 61 so as to secure the head module 1 in place, thereby completing the mounting procedure.

Thus, the printhead P0 according to this patent specification has the head module 1 positioned vertically with the contact ribs 72*f* and 72*s* of the nozzle plate 11 contacting the bottom surface 60*a* of the mount base 60, and horizontally with the reference edges 70 and 71 of the nozzle plate 11 contacting the reference pin 64 of the mount base 60.

In particular, the direct contact between the nozzle plate 11 and the mount base 60 ensures the printhead P0 has the nozzle face 11*a* vertically positioned with high accuracy irrespective of variations in the total thickness of the channel plate 12, the vibratory plate 13, and the adhesive layers between components of the chamber unit 2. This results in an extremely narrow and consistent gap between the nozzle face 11*a* and a recording medium passing below the printhead P0 during printing, leading to reliable ink ejecting performance and enhanced inkjet printing quality.

Moreover, the printhead P0 according to this patent specification is readily assembled and disassembled with the simple positioning mechanism based on the direct contact between the ribbed nozzle plate 11 and the mount base 60. In particular, the opening 65 allowing unidirectional insertion of the head module 1 into the mount base 60 enables replacement of each head module 1 without demounting the entire printhead P0, leading to ready maintenance of the image forming apparatus or liquid ejecting device incorporating the modular printhead P0.

Although the embodiment described above provides horizontal positioning of the head module 1 by establishing direct contact between the edges 70 and 71 of the nozzle plate 11 and the reference pin 64 of the mount base 60, alternatively, it is also possible to position the head module 1 by engaging a reference pin on the mount base with a corresponding through-hole defined in the nozzle plate 11.

Further, although the embodiment above describes positioning of the head module 1 by direct contact between the mount base 60 and the nozzle plate 11, the positioning mechanism according to this patent specification may use the channel plate 12 or the vibratory plate 13 instead of the nozzle plate 11 as a positioning member to define a surface to contact the mount base surface 60*a*. As mentioned, each of the constituent layers of the chamber unit 2, including the nozzle plate 11, the channel plate 12, and the vibratory plate 13, is a thin component machined with extremely high dimensional accuracy, and is positioned in good alignment with each other using the precision alignment technique described above. This means there exists little variation in these precise components, so that any of the constituent layers of the chamber unit 2 can function as the positioning member to define a surface to contact the bottom surface 60*a*.

Figure 11:
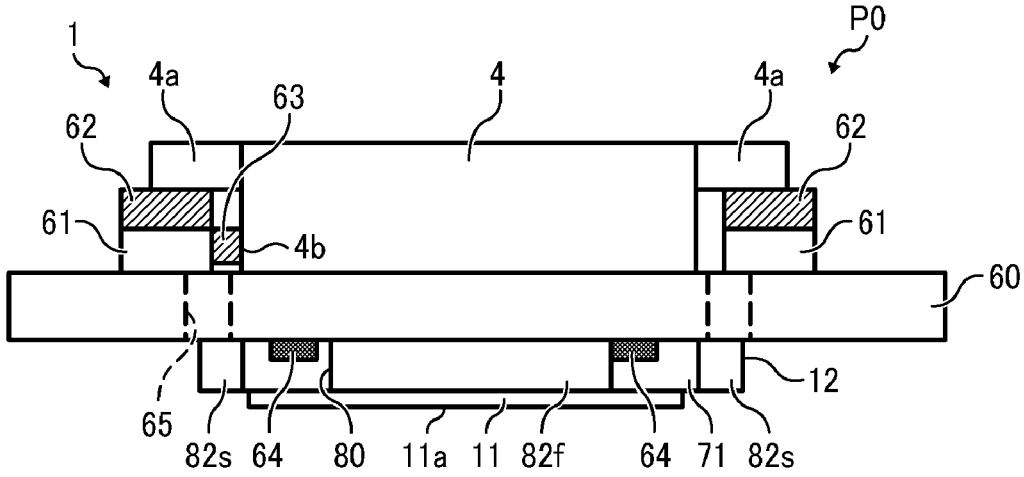
FIGS. 11 and 12 are front elevational and bottom-plan views, respectively, schematically illustrating an alternative embodiment of the printhead of FIG. 1.
Figure 12:
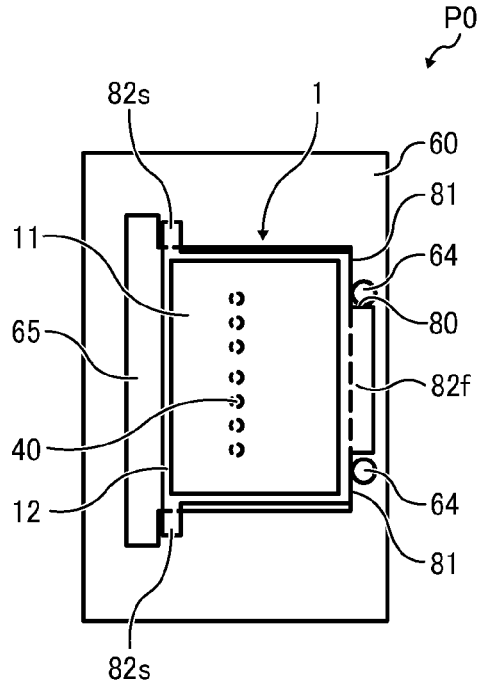

FIGS. 11 and 12 are front elevational and bottom-plan views, respectively, schematically illustrating an embodiment of the printhead P0 in which the channel plate 12 instead of the nozzle plate 11 serves as a positioning member.

As shown in FIGS. 11 and 12, this embodiment is similar to that described in FIGS. 6 through 8, except that the channel plate 12 instead of the nozzle plate 11 is ribbed to establish contact with the mount base 60.

Specifically, the channel plate 12 has a front contact rib 82*f* projecting from a longitudinal edge parallel to the array of nozzles 40, and a pair of side contact ribs 82*s* projecting from opposing side edges perpendicular to the longitudinal edge. The front and side contact ribs 82*f* and 82*s* of the channel plate 12 contact the bottom surface 60*a* of the mount base 60 around the opening 65, and two perpendicular edges 80 and 81 of the channel plate 12 contact one of the reference pins 64 of the mount base 60.

Accordingly, the first springs 62 vertically urging the extensions 4*a* away from the top surface of the base 60 ensures secure contact between the surface of the channel plate 12 and the bottom surface 60*a* of the mount base 60. Similarly, the second spring 63 laterally urging the side 4*b* of the frame 4 ensures secure contact between the edge 80 of the channel plate 12 and the reference pin 64 of the mount base 60.

Although directly contacting the nozzle plate 11 and the mount base 60 is superior in accurately positioning the nozzle face and the nozzle array, the embodiment described in FIGS. 11 and 12 provides a more durable positioning mechanism than that described in FIGS. 6 through 8, since the channel plate 12 is less susceptible to damage than the nozzle plate 11 when contacting and/or pressed against the mount base 60. Such durability of the positioning mechanism may also be effected by a configuration in which the vibratory plate 13 is used to establish direct contact with the mount base 60.

As mentioned, the printhead P0 according to this patent specification is constructed with one or more head modules 1 arranged in a particular configuration according to specific application. The following describes configurations of the printhead P0 with multiple head modules 1 arranged for application to serial and line inkjet printers.

Figure 13:
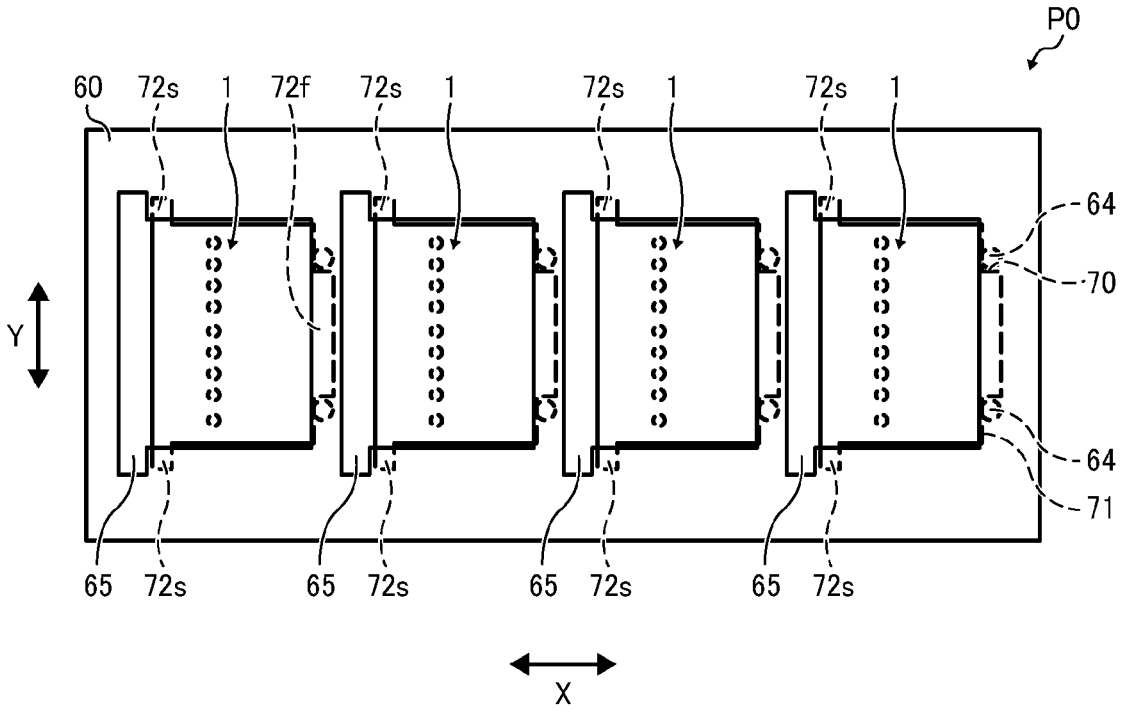
FIG. 13 is a plan view schematically illustrating one configuration of the printhead of FIGS. 6 through 8 for installation in a serial inkjet printer.

FIG. 13 is a plan view schematically illustrating one configuration of the printhead P0 for installation in a serial inkjet printer, taken from above with components of the head modules 1 other than the nozzle plates 11 being removed for clarity.

As shown in FIG. 13, the serial inkjet printhead P0 has multiple (e.g., four in this embodiment) head modules 1 arranged along a main scan direction X perpendicular to a sub-scan direction Y in which a recording medium or sheet moves parallel to the nozzle arrays spanning a given swath in a print zone. Although the illustrated configuration has the multiple nozzle arrays with endmost nozzles aligned with each other in the main scan direction X, the corresponding nozzles of respective arrays may be displaced in the sub-scan direction Y for an application where the printhead P0 is required to eject ink at higher densities.

Figure 14:
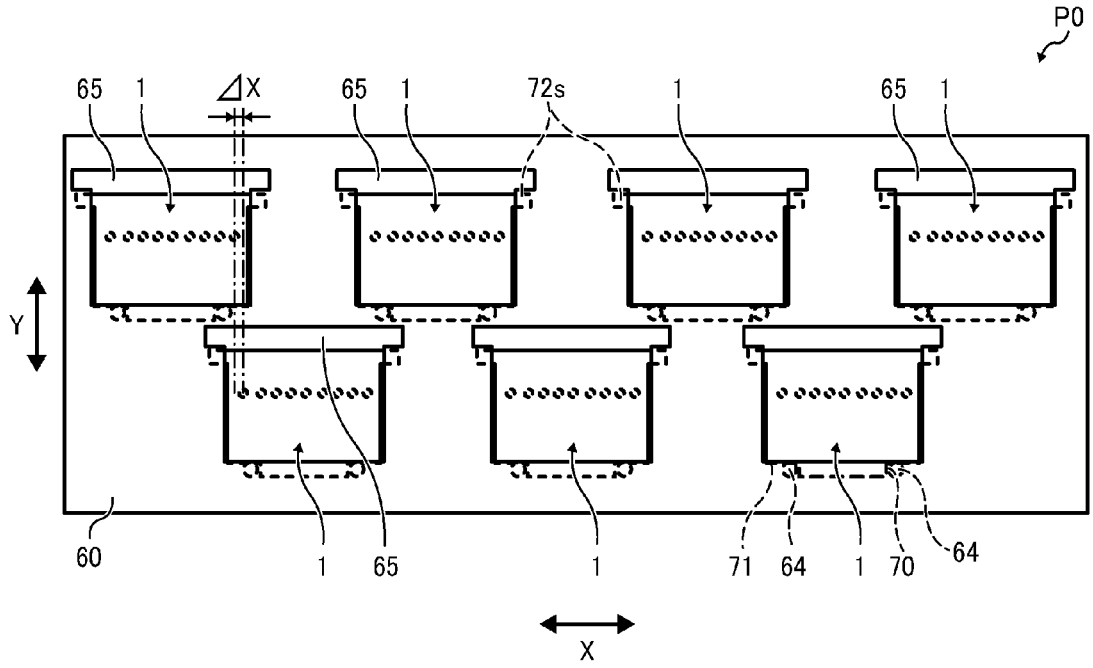
FIG. 14 is a plan view schematically illustrating one configuration of the printhead of FIGS. 6 through 8 for installation in a line inkjet printer.

By contrast, FIG. 14 is a plan view schematically illustrating a printhead P0 for installation in a line inkjet printer, taken from above with components of the head modules 1 other than the nozzle plates 11 being removed for clarity.

As shown in FIG. 14, the line inkjet printhead P0 has multiple (e.g., seven in this embodiment) head modules 1 staggered in two rows each extending along a direction X perpendicular to a sub-scan direction Y in which a recording medium or sheet moves perpendicular to the nozzle arrays spanning the width of a print zone equivalent to the width of a recording sheet. Although the illustrated configuration has the staggered pattern with endmost nozzles of two neighboring nozzle arrays being displaced from each other by a distance $\Delta x$ along the main scan direction X, each nozzle array may partially overlap a neighboring nozzle array for an application where the printhead P0 is required to eject ink at higher densities.

In both configurations described in FIGS. 13 and 14, the multiple head modules 1 included in the printhead P0 are aligned relative to each other not only in the horizontal directions X and Y but also in the vertical direction perpendicular to the XY plane, since each head module 1 is accurately positioned horizontally with the edges 70 and 71 of the nozzle plate 11 contacting the reference pin 64, and vertically with the ribs 72 of the nozzle plate 11 contacting the mount base surface 60*a*. This effects a proper alignment of multiple nozzle arrays in the horizontal directions, and a constant gap between the nozzles and the recording medium in the print zone, resulting in high printing performance of the modular inkjet printhead P0 according to this patent specification.

Figure 15:
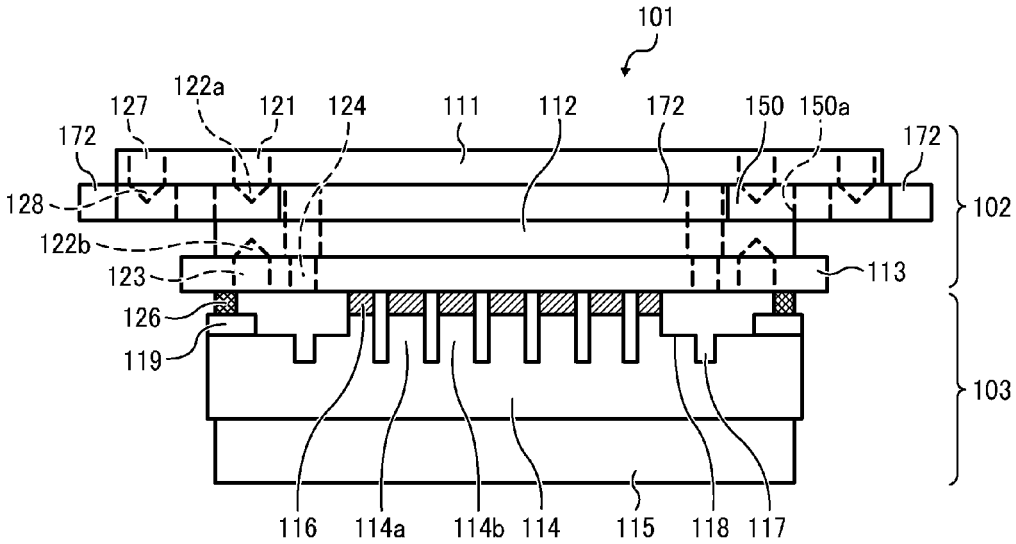
FIG. 15 is a side-elevational view schematically illustrating a head module incorporated in an inkjet printhead according to another embodiment of this patent specification.

FIG. 15 is a side-elevational view schematically illustrating a head module 101 incorporated in an inkjet printhead P1, not shown, according to another embodiment of this patent specification.

As shown in FIG. 15, the head module 101 is a piezoelectric liquid ejector module including a laminate chamber unit 102 and a piezoelectric driver unit 103 combined together. As will be described hereinbelow, the chamber unit 102 and the driver unit 103 are integrally held in a frame 104, not shown, for mounting on the printhead P1 which may have one or more head modules 101 arranged in a particular configuration.

In the head module 101, the chamber unit 102 includes a nozzle plate 111, a channel plate 112, and a vibratory plate 113, stacked in tiers to form a laminate structure internally defining fluid paths and chambers allowing ink to flow therethrough. The internal structure of the chamber unit 102 is detailed with reference to FIGS. 16 and 17, which are plan views schematically illustrating the nozzle plate 111 and the channel plate 112, respectively, before assembly.

Figure 16:
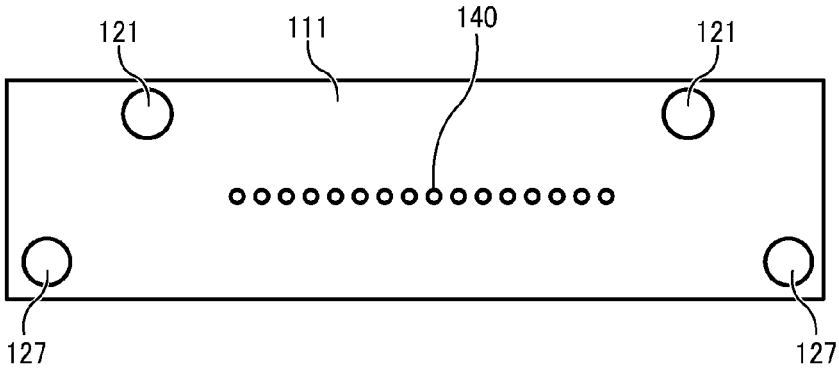
FIG. 16 is a plan view schematically illustrating a nozzle plate included in the head module of FIG. 15 before assembly.
Figure 17:
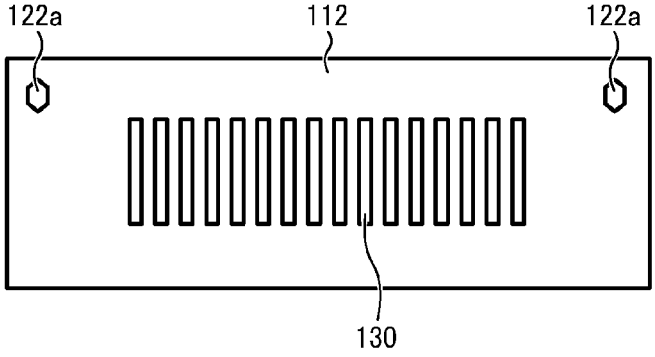
FIG. 17 is a plan view schematically illustrating a channel plate included in the head module of FIG. 15 before assembly.

As shown in FIG. 16, the nozzle plate 111 defines an array of multiple nozzles 140 for ejecting ink in droplets. Correspondingly, the channel plate 112 defines multiple ink chambers 130 for holding ink as shown in FIG. 17, which are walled at least partially with the vibratory plate 113 and establish fluid communication with the multiple nozzles 140 in the assembled chamber unit 102.

With additional reference to FIG. 19, which is a plan view schematically illustrating the chamber unit 2 during assembly, the laminate chamber unit 102 according to the present embodiment has the nozzle plate 111 combined with a positioning plate 150 surrounding the channel plate 112 below the nozzle plate 111. Specifically, the positioning plate 150 is a flat piece of rigid material with a rectangular opening 150*a* defined therein to accommodate the lateral dimensions of the channel plate 112, and a front rib 172*f* projecting from a longitudinal edge thereof and a pair of side ribs 172*s* projecting from opposing edges perpendicular to the longitudinal edge. The positioning plate 150 forms part of a mechanism to position the head module 101 in the printhead P1 as will be detailed hereinbelow.

In the chamber unit 102, the nozzle plate 111 has a pair of through-holes 121 on opposing sides thereof corresponding to a pair of alignment marks 122*a* on opposing sides of the channel plate 112, as well as a pair of through-holes 127 on opposing sides thereof corresponding to a pair of through-holes 128 on opposing sides of the positioning plate 150 for alignment purposes. Similarly, the vibratory plate 113 has a pair of through-holes 123 on opposing sides thereof corresponding to a pair of alignment marks 122*b* on opposing sides of the channel plate 112 for alignment purposes.

The driver unit 103 includes a pair of multilayer piezoelectric elements 114 (e.g., actuators formed of 10 or more piezoelectric layers) arranged parallel to each other and bonded to a substrate 115 with an adhesive, of which only one is shown in the side view. Each piezoelectric element 114 has active portions 114*a* and intermediate passive support portions 114*b* alternating and separate from each other, formed by slitting or die-cutting a piezoelectric material with a dicing saw or through other suitable fabrication processes.

The chamber unit 102 and the driver unit 103 are bonded by an adhesive layer 116 securing upper surfaces of the piezoelectric portions 114*a* and 114*b* to the vibratory plate 113, and the nozzle plate 111, the channel plate 112, and the vibratory plate 113 in the chamber unit 102 are bonded together with an adhesive applied to upper and lower surfaces of the middle channel plate 112.

In use, the head module 101 is mounted in the printhead P1 with the chamber unit 102 down and the driver unit 103 up so that the nozzle plate 111 faces a recording medium passing below the printhead P1. The chamber unit 102 is supplied with ink from a suitable ink source, not shown, and holds ink in the ink chambers 130 for supplying the corresponding nozzles 140. To print an image, the driver unit 103 selectively drives the active portions 114*a* with electronic pulses, while the support portions 114*b*, remaining non-pulsed, support the chamber unit 102 in place. This causes the active portions 114*a* to pressurize the ink chambers 130, which in turn activate the corresponding nozzles 140 to expel droplets of ink downward onto the recording medium to form an image thereon.

For the printhead P1 to perform printing with good imaging quality, it is important that the printhead P1 have multiple head modules 101 each formed with high dimensional accuracy and properly positioned with respect to each other, forming the nozzle face at a consistent distance close to the recording medium in the print zone. For this purpose, the head module 101 according to this patent specification has its components, particularly the nozzle plate 111, the channel plate 112, and the vibratory plate 113 forming the chamber unit 102, as well as the positioning plate 150, each machined with extremely high dimensional accuracy, and accurately positioned with respect to each other when assembled into a single unit. In particular, the constituent members of the chamber unit 102 are positioned relative to each other to an accuracy of ±1 μm or better using a precision alignment technique based on image processing described as follows.

Figure 18:
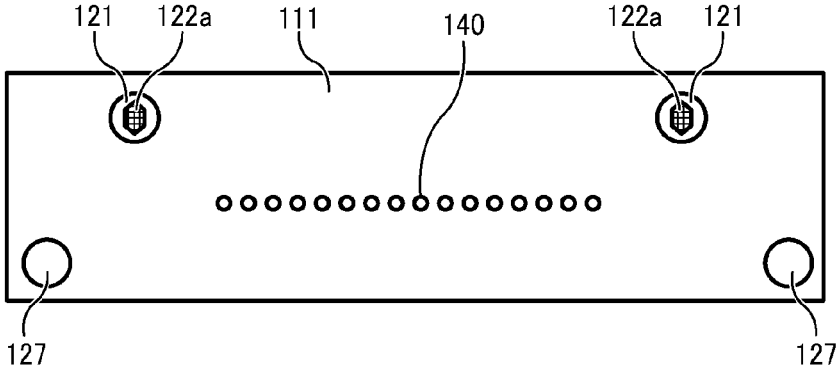
FIG. 18 is a plan view schematically illustrating the nozzle plate aligned with the channel plate.

FIG. 18 is a plan view schematically illustrating the nozzle plate 111 aligned with the channel plate 112 in the chamber unit 102. As shown in FIG. 18, during assembly, the nozzle plate 111 is placed above the channel plate 112 so that the alignment marks 122*a* of the channel plate 112 are visible through the through-holes 121 on the upper side of the nozzle plate 111.

With the two plates 111 and 112 thus stacked one atop another, digital image processing is performed using imaging equipment to determine a pair of imaginary reference points, one midway between the through-holes 121 and the other midway between the alignment marks 122*a*, as well as a pair of imaginary reference lines, one connecting the through-holes 121 and the other connecting the alignment marks 122*a*. The channel plate 112 is registered relative to the nozzle plate 111 so as to reduce the distance between the reference points and the angle formed by the reference lines to specified acceptable values. The nozzle plate 111 and the channel plate 112 after positioning are forced against each other and bonded together with a suitable temporary bond such as an ultraviolet (UV) curable adhesive.

Also, the vibratory plate 113 is stacked on the channel plate 112 so that the alignment marks 122*b* of the channel plate 112 are visible through the through-holes 123 on the upper side of the vibratory plate 113. Then, digital image processing is performed to register the channel plate 112 relative to the vibratory plate 113 so as to reduce the displacement between the alignment marks 122*b* and the through-holes 123 in the manner described above, followed by bonding the plates 112 and 113 with a suitable temporary bond.

Moreover, the positioning plate 150 is positioned in the head module 101 using the precision alignment technique described above. Specifically, as shown in FIG. 19, the nozzle plate 111 is placed above the positioning plate 150 so that the through-holes 128 of the positioning plate 150 are visible through the through-holes 127 on the upper side of the channel plate 111.

With the two plates 111 and 150 thus stacked one atop another, digital image processing is performed to register the positioning plate 150 relative to the nozzle plate 111 so as to reduce the displacement between the through-holes 127 and the through-holes 128 in the manner described above, followed by bonding the plates 111 and 150 with a suitable temporary bond. The perimeters of the positioning plate 150 contacting the nozzle plate 111 may be sealed with a suitable sealing agent if required.

After positioning the nozzle plate 111, the channel plate 112, and the vibratory plate 113, as well as the positioning plate 150 relative to each other, the chamber unit 102 is completed by bonding the constituent layers 111, 112, and 113 with a permanent adhesive.

When the chamber unit 102 and the driver unit 103 are obtained, these sub-assemblies are integrated into a single head module 101. This involves positioning the chamber unit 102 and the driver unit 103 relative to each other by aligning a pair of through-holes 124 on opposing sides of the vibratory plate 113 with a pair of alignment grooves 117 on recessed portions 118 of the piezoelectric element 114 and subsequently depositing a temporary bond 126 on raised edges 119 of the piezoelectric element 114 for holding the vibratory plate 113 thereto, followed by permanently bonding the chamber unit 102 and the driver unit 103 with the adhesive layer 116 applied between the vibratory plate 113 and the piezoelectric element 114.

Figure 20:
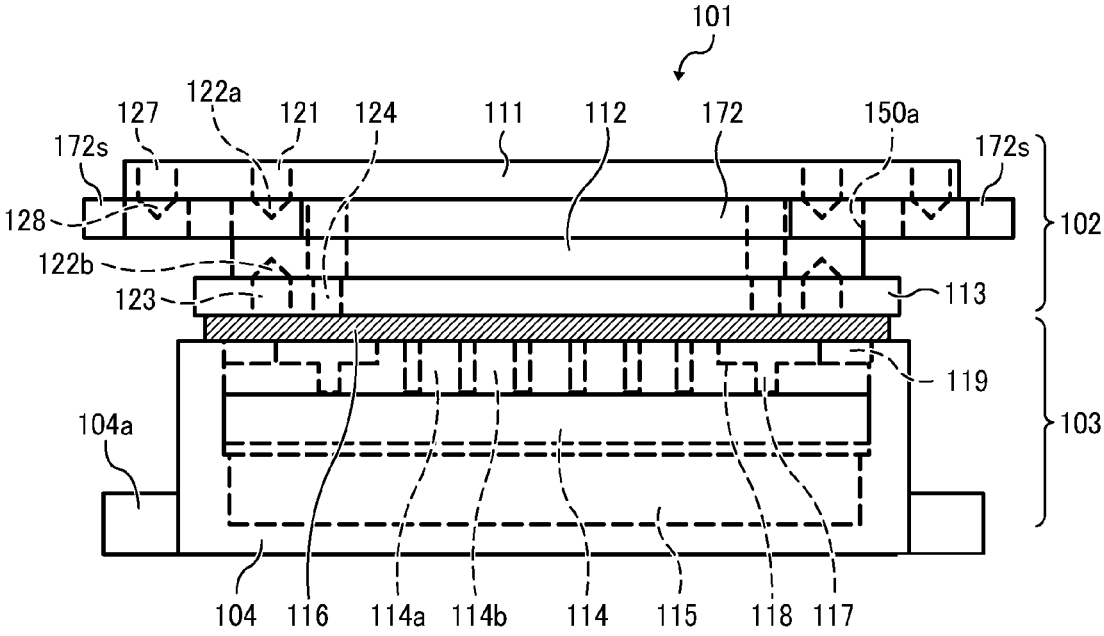
FIG. 20 is a side-elevational view schematically illustrating the head module of FIG. 15 after completion.

Thereafter, the integrated head module 101 is fitted into the frame 104 for completion. Fitting the head module 101 in the frame 104 involves positioning the head module 101 relative to the frame 104, inserting and pressing the driver unit 103 into the frame 104, applying an ultraviolet (UV) curable adhesive to contact surfaces, and curing the adhesive under exposure to UV light. As shown in FIG. 20, which is a side-elevational view schematically illustrating the head module 101 after completion, the frame 104 has a pair of horizontal extensions 4*a* on opposing sides for supporting the head module 101 in place on the printhead P1 as will be described hereinbelow. The head module 101 thus completed with the frame 104 is ready for mounting on the printhead P1.

Figure 19:
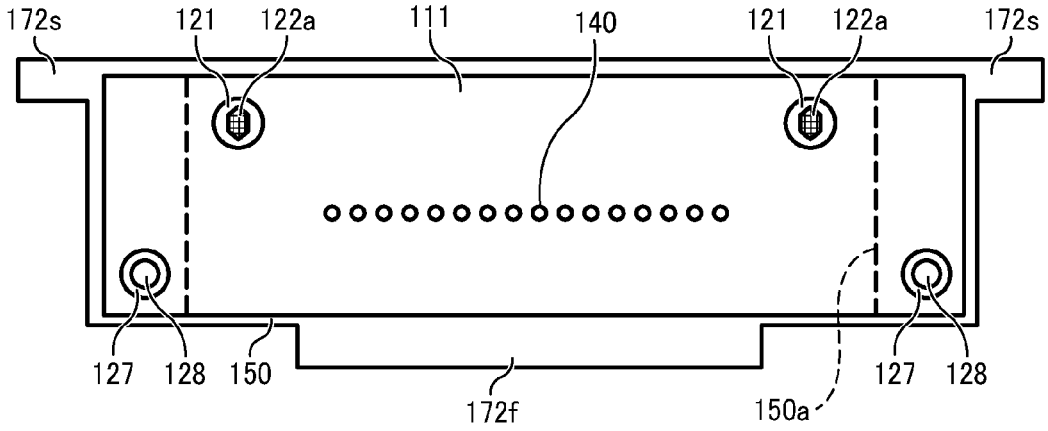
FIG. 19 is a plan view schematically illustrating the nozzle plate aligned with the channel plate and a positioning plate.

Although the positioning plate 150 in the present embodiment is configured as a flat plate with a rectangular opening defined therein, the configuration of the positioning plate 150 may be other than that described in FIG. 19, such as a flat plate with a U-shaped opening, depending on the size, stiffness, or other physical properties of the head module, as well as the assembly procedure by which the head module is manufactured. In other words, the assembly procedure may vary depending on the configuration of the positioning plate 150. For example, a positioning plate 150 with an opening greater than the channel plate 112 and smaller than the vibratory plate 113 is to be combined with the nozzle plate 111 prior to positioning and combining the nozzle plate 111 with the vibratory plate 112. On the other hand, a positioning plate 150 with a U-shaped opening allows for horizontal insertion of the channel plate 112, so that it may be positioned and combined with the nozzle plate 111 after completing the head module 1 with the frame 4 attached to the vibratory plate 113.

Figure 21:
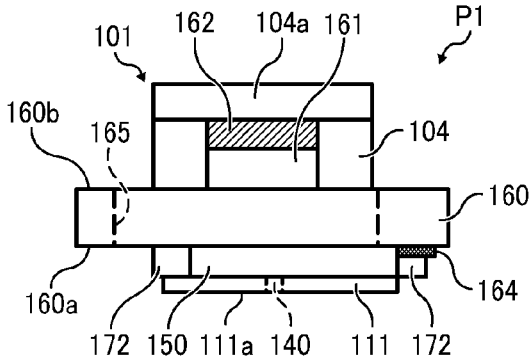
FIGS. 21 through 23 are side-elevational, front elevational, and bottom-plan views, respectively, schematically illustrating the printhead with the head module of FIG. 20 mounted thereon.
Figure 22:
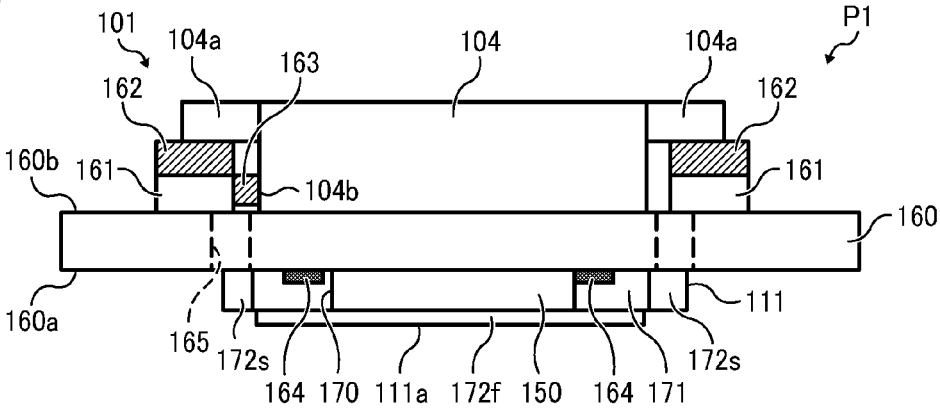
Figure 23:
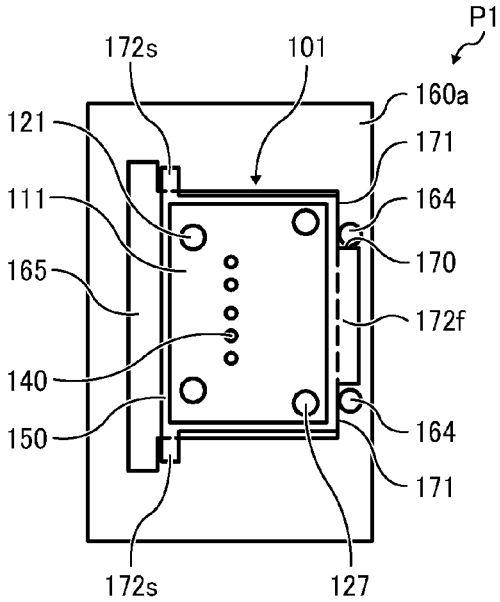

FIGS. 21 through 23 are side-elevational, front elevational, and bottom-plan views, respectively, schematically illustrating the printhead P1 with the head module 101 of FIG. 20 mounted thereon.

As shown in FIGS. 21 through 23, the head module 101 is inserted into a mount base 160 with the nozzle plate 111 down so as to locate a nozzle face 111*a* at the bottom of the printhead assembly P1. The mount base 160 has a bottom positioning surface 160*a* facing downward (i.e., in the direction in which the printhead P1 ejects ink) and a top surface 160*b* opposite the bottom surface 160*a*, holding the head module 101 with an upper surface of the positioning plate 150 (i.e., the surface opposite the nozzle face 111*a*) contacting the positioning surface 160*a* of the mount base 160.

Specifically, the mount base 160 has an opening 165 shaped to accommodate the lateral dimensions of the positioning plate 150, a pair of support blocks 161 on the top surface 160*b*, and a pair of reference pins 164 on the bottom surface 160*a* beside a longitudinal edge of the opening 165. The front and side contact ribs 172*f* and 172*s* of the positioning plate 150 contact the positioning surface 160*a* of the mount base 160 around the opening 165, and two perpendicular edges 170 and 171 of the positioning plate 150 contact one of the reference pins 164 of the mount base 160.

Further, the printhead assembly P1 also has a pair of first springs (e.g., leaf springs) 162 disposed between the horizontal extensions 4*a* of the frame 104 and the support blocks 161 of the mount base 160 on both side, and a second spring (e.g., leaf springs) 163 disposed between a side 104*b* of the frame 104 and the support block 161 on the corresponding side. The first springs 162 vertically urging the extensions 104*a* away from the top surface of the base 160 ensure secure contact between the surface of the positioning plate 150 and the bottom surface 160*a* of the mount base 160. Similarly, the second spring 163 laterally urging the side 104*b* of the frame 104 ensures secure contact between the edge 170 of the positioning plate 150 and the reference pin 164 of the mount base 160.

Figure 24:
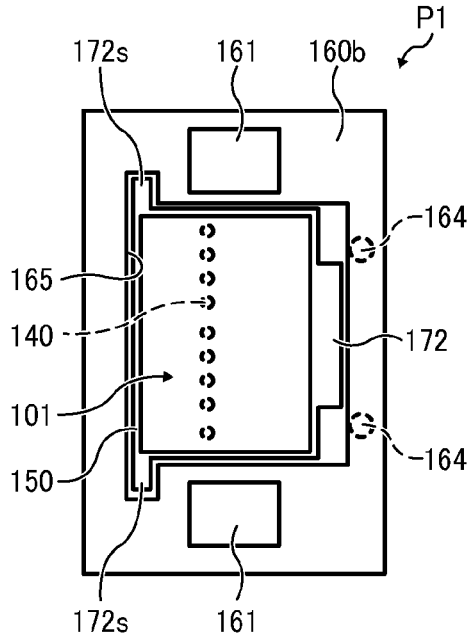
FIGS. 24 and 25 schematically illustrate mounting of the head module of FIG. 20 on a mount base viewed from above.
Figure 25:
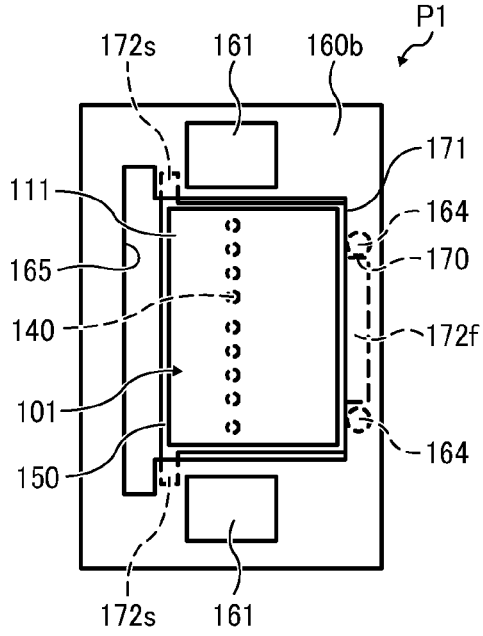

FIGS. 24 and 25 schematically illustrate mounting of the head module 101 on the mount base 160 viewed from above, with components of the head module 101 other than the nozzle plate 111 and the positioning plate 150 being removed for clarity.

As shown in FIG. 24, the head module 101 is inserted through the opening 165 of the base 160 with the nozzle face 111*a* down until the contact ribs 172 of the positioning plate 150 reach below the bottom surface 160*a* of the base 160. Although not visible in the drawing, at this point, the head module 101 has the horizontal extensions 104*a* of the frame 104 resting on the support blocks 161 of the base 160.

After insertion, the head module 101 is slid sideways until the perpendicular edges 170 and 171 of the positioning plate 150 contact the reference pin 164 as shown in FIG. 25. Then, the first springs 162 are inserted between the extensions 104*a* and the support blocks 161, and the second spring 163 is inserted between the side 104*b* of the frame 104 and the support block 161 on the corresponding side, causing the contact ribs 172*f* and 172*s* to reliably contact the bottom surface 160*a* of the base 160, and the reference edges 170 and 171 to reliably contact the reference pin 64 of the base 160. Subsequently, the extensions 104*a* of the frame 104 are fastened (e.g., with screws) to the corresponding support blocks 161 so as to secure the head module 101 in place, thereby completing the mounting procedure.

Thus, the printhead P1 according to this patent specification has the head module 101 positioned vertically with the contact ribs 172*f* and 172*s* of the positioning plate 150 combined with the nozzle plate 111 contacting the bottom surface 160*a* of the mount base 160, and horizontally with the reference edges 170 and 171 of the positioning plate 150 contacting the reference pin 164 of the mount base 160.

In particular, the direct contact between the positioning plate 150 and the mount base 160 ensures the printhead P1 has the nozzle face 111*a* vertically positioned with high accuracy irrespective of variations in the total thickness of the channel plate 112, the vibratory plate 113, and the adhesive layers between components of the chamber unit 102. This results in an extremely narrow and consistent gap between the nozzle face 111*a* and a recording medium passing below the printhead P1 during printing, leading to reliable ink ejecting performance and enhanced inkjet printing quality.

Moreover, the printhead P1 according to this patent specification is readily assembled and disassembled with the simple positioning mechanism based on the direct contact between the ribbed positioning plate 150 and the mount base 160. In particular, the opening 165 allowing unidirectional insertion of the head module 101 into the mount base 160 enables replacement of each head module 101 without demounting the entire printhead P1, leading to ready maintenance of the image forming apparatus or liquid ejecting device incorporating the modular printhead P1.

Although the embodiment described above provides horizontal positioning of the head module 101 by establishing direct contact between the edges 170 and 171 of the positioning plate 150 and the reference pin 164 of the mount base 160, alternatively, it is also possible to position the head module 101 by engaging a reference pin on the mount base with a corresponding through-hole defined in the positioning plate 150.

Further, the positioning mechanism according to this patent specification may use a positioning plate combined with the channel plate 112 or the vibratory plate 113 instead of the nozzle plate 111 to define a surface to contact the mount base surface 160*a*. As mentioned, each of the constituent layers of the chamber unit 102, including the nozzle plate 111, the channel plate 112, and the vibratory plate 113, as well as the positioning plate 150, is a thin component machined with extremely high dimensional accuracy, and is positioned in good alignment with each other using the precision alignment technique described above. This means there exists little variation in these precise components, so that the positioning plate combined with any of the constituent layers of the chamber unit 102 can function properly to define a surface to contact the mount base surface 160*a*. Although the positioning plate 150 combined with the nozzle plate 111 defining the nozzles 40 is superior in accurately positioning the nozzle face and the nozzle array, combining the positioning plate 150 with the channel plate 112 or the vibratory plate 113 provides a more durable positioning mechanism than that described in FIGS. 21 through 23.

As mentioned, the printhead P1 according to this patent specification is constructed with one or more head modules 101 arranged in a particular configuration according to specific application. The following describes configurations of the printhead P1 with multiple head modules 101 arranged for application to serial and line inkjet printers.

Figure 26:
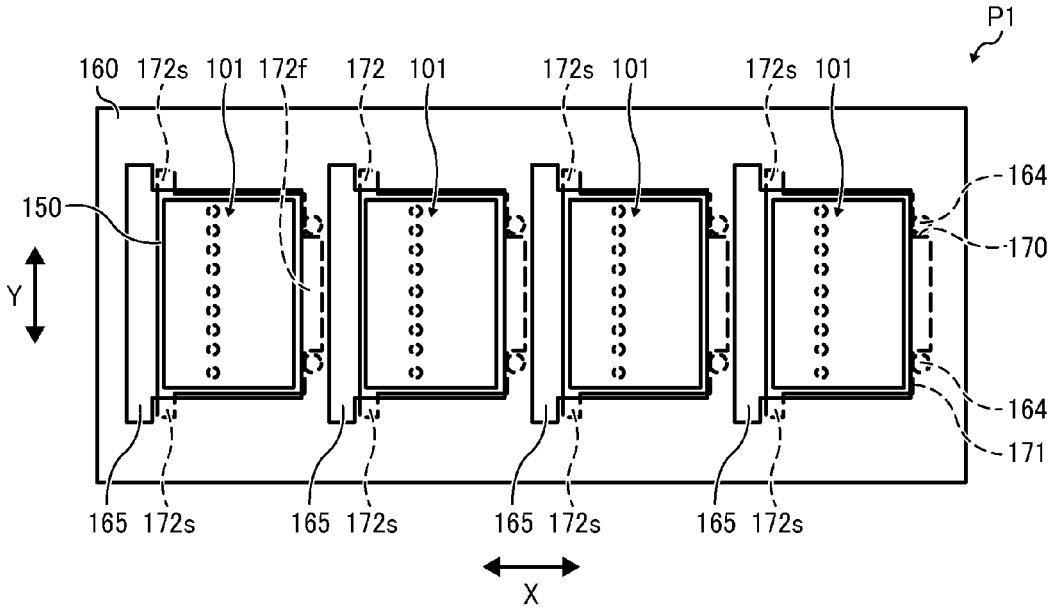
FIG. 26 is a plan view schematically illustrating one configuration of the printhead of FIGS. 21 through 23 for installation in a serial inkjet printer.

FIG. 26 is a plan view schematically illustrating one configuration of the printhead P1 for installation in a serial inkjet printer, taken from above with components of the head modules 101 other than the nozzle plates 111 being removed for clarity.

As shown in FIG. 26, the serial inkjet printhead P1 has multiple (e.g., four in this embodiment) head modules 101 arranged along a main scan direction X perpendicular to a sub-scan direction Y in which a recording medium or sheet moves parallel to the nozzle arrays spanning a given swath in a print zone. Although the illustrated configuration has the multiple nozzle arrays with endmost nozzles aligned with each other in the main scan direction X, the corresponding nozzles of respective arrays may be displaced in the sub-scan direction Y for an application where the printhead P1 is required to eject ink at higher densities.

Figure 27:
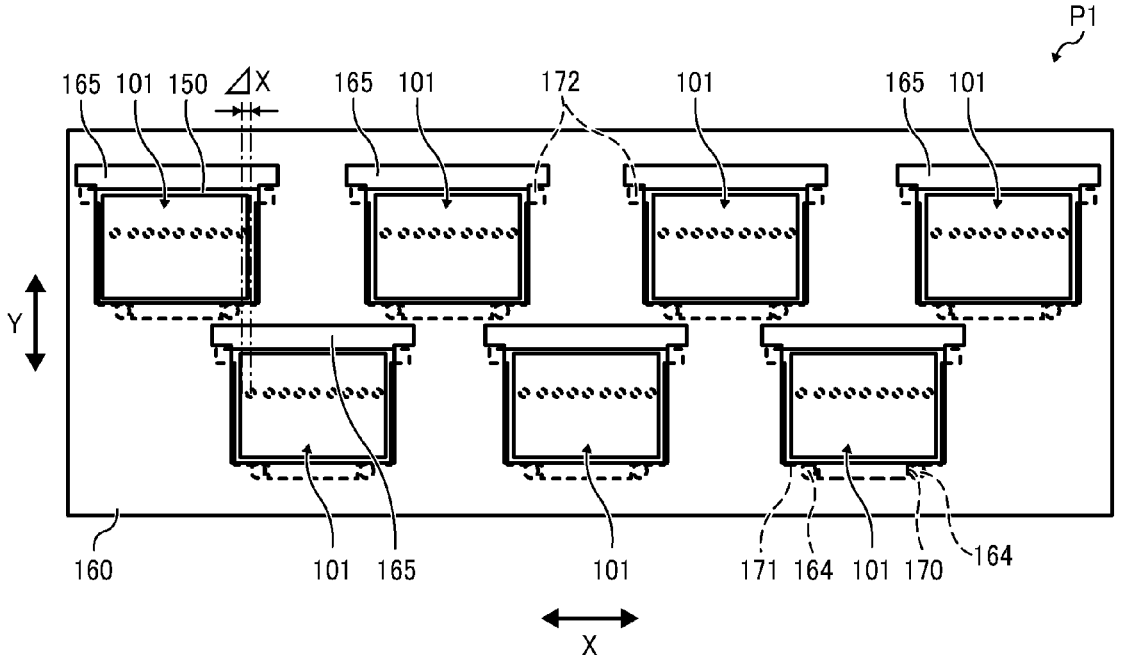
FIG. 27 is a plan view schematically illustrating one configuration of the printhead of FIGS. 21 through 23 for installation in a line inkjet printer.

By contrast, FIG. 27 is a plan view schematically illustrating a printhead P1 for installation in a line inkjet printer, taken from above with components of the head modules 101 other than the nozzle plates 111 being removed for clarity.

As shown in FIG. 27, the line inkjet printhead P1 has multiple (e.g., seven in this embodiment) head modules 101 staggered in two rows each extending along a direction X perpendicular to a sub-scan direction Y in which a recording medium or sheet moves perpendicular to the nozzle arrays spanning the width of a print zone equivalent to the width of a recording sheet. Although the illustrated configuration has the staggered pattern with endmost nozzles of two neighboring nozzle arrays being displaced from each other by a distance $\Delta x$ along the main scan direction X, each nozzle array may partially overlap a neighboring nozzle array for an application where the printhead P1 is required to eject ink at higher densities.

In both configurations described in FIGS. 26 and 27, the multiple head modules 101 included in the printhead P1 are aligned relative to each other not only in the horizontal directions X and Y but also in the vertical direction perpendicular to the XY plane, since each head module 101 is accurately positioned horizontally with the edges 170 and 171 of the positioning plate 150 contacting the reference pin 164, and vertically with the ribs 172 of the positioning plate 150 contacting the mount base surface 160*a*. This effects a proper alignment of multiple nozzle arrays in the horizontal directions, and a constant gap between the nozzles and the recording medium in the print zone, resulting in high printing performance of the modular inkjet printhead P1 according to this patent specification.

Figure 28:
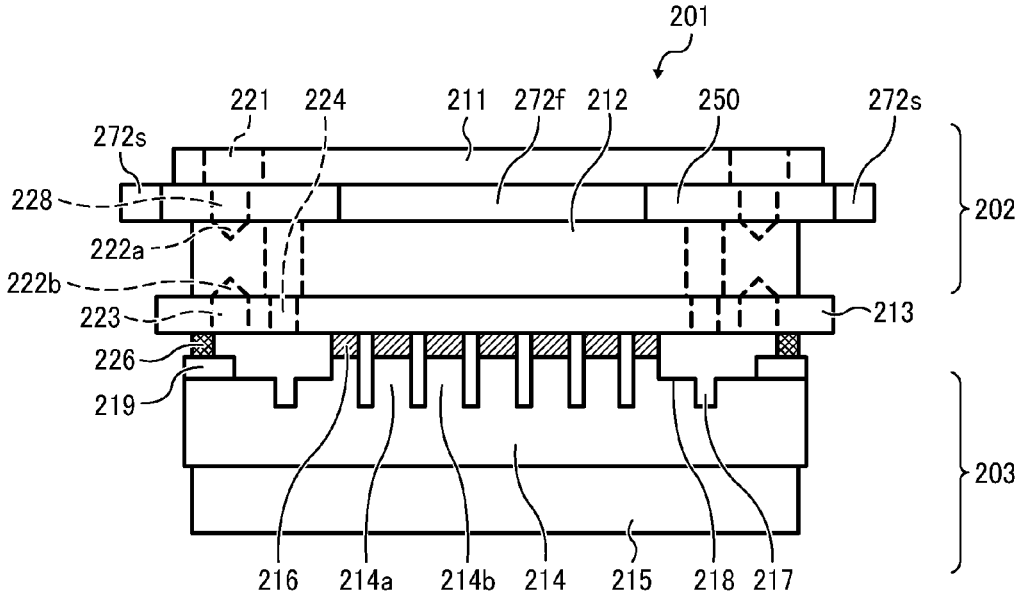
FIG. 28 is a side-elevational view schematically illustrating a head module incorporated in an inkjet printhead according to still another embodiment of this patent specification.

FIG. 28 is a side-elevational view schematically illustrating a head module 201 incorporated in an inkjet printhead P2, not shown, according to still another embodiment of this patent specification.

As shown in FIG. 28, the head module 201 is a piezoelectric liquid ejector module including a laminate chamber unit 202 and a piezoelectric driver unit 203 combined together. As will be described hereinbelow, the chamber unit 202 and the driver unit 203 are integrally held in a frame 204, not shown, for mounting on the printhead P2 which may have one or more head modules 201 arranged in a particular configuration.

In the head module 201, the chamber unit 202 includes a nozzle plate 211, an intermediate positioning plate 250, a channel plate 212, and a vibratory plate 213, stacked in tiers to form a laminate structure internally defining fluid paths and chambers allowing ink to flow therethrough. The internal structure of the chamber unit 202 is detailed with reference to FIGS. 29 and 30, which are plan views schematically illustrating the nozzle plate 211 and the channel plate 212, respectively, before assembly.

Figure 29:
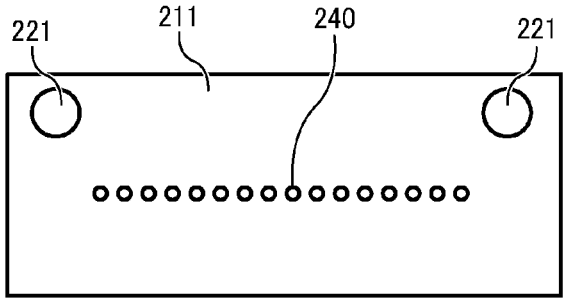
FIG. 29 is a plan view schematically illustrating a nozzle plate included in the head module of FIG. 28 before assembly.
Figure 30:
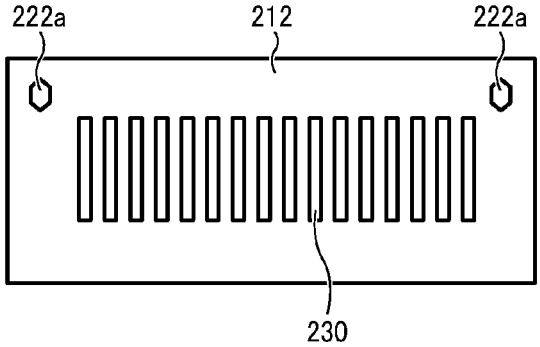
FIG. 30 is a plan view schematically illustrating a channel plate included in the head module of FIG. 28 before assembly.

As shown in FIG. 29, the nozzle plate 211 defines an array of multiple nozzles 240 for ejecting ink in droplets. Correspondingly, the channel plate 212 defines multiple ink chambers 230 for holding ink as shown in FIG. 30, which are walled at least partially with the vibratory plate 213 and establish fluid communication with the multiple nozzles 240 in the assembled chamber unit 202.

Figure 31:
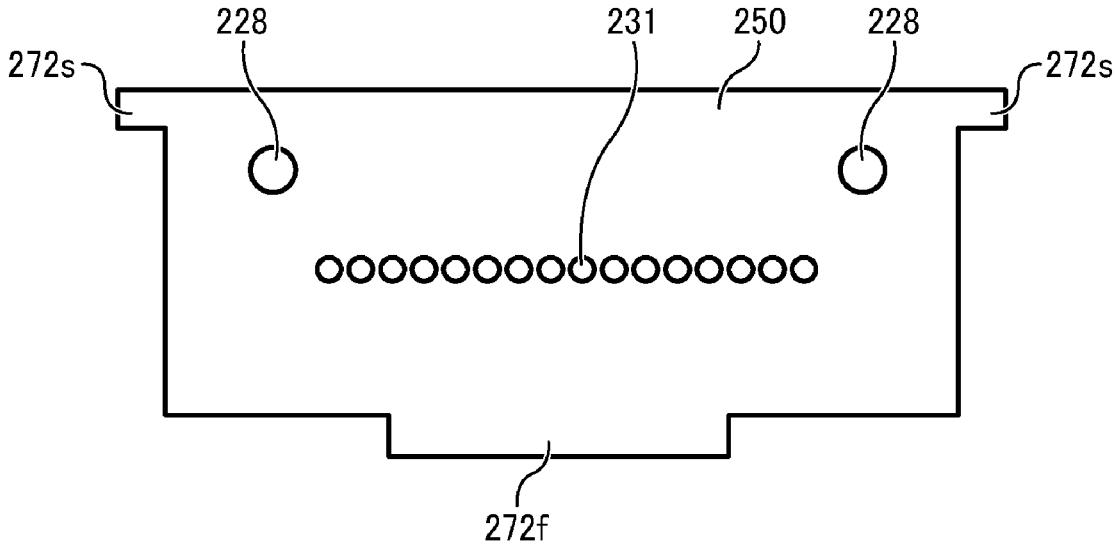
FIG. 31 is a plan view schematically illustrating an intermediate plate included in the head module of FIG. 28 before assembly.

As mentioned, the laminate chamber unit 202 according to the present embodiment has the intermediate positioning plate 250 inserted between the nozzle plate 211 and the channel plate 212. Specifically, with particular reference to FIG. 31, which is a plan view schematically illustrating the intermediate plate 250 before assembly, the intermediate plate 250 is a flat piece of rigid material, such as ceramic or stainless steel, defining multiple orifices 231 through which the ink chambers 230 connect to the nozzles 240. The positioning plate 250 also has a front rib 272*f* projecting from a longitudinal edge thereof and a pair of side ribs 272*s* projecting from opposing edges perpendicular to the longitudinal edge. The positioning plate 250 forms part of a mechanism to position the head module 201 in the printhead P2 as will be detailed hereinbelow.

In the chamber unit 202, the nozzle plate 211 has a pair of through-holes 221 on opposing sides thereof corresponding to a pair of alignment marks 222*a* on opposing sides of the channel plate 212 for alignment purposes. Similarly, the vibratory plate 213 has a pair of through-holes 223 on opposing sides thereof corresponding to a pair of alignment marks 222*b* on opposing sides of the channel plate 212 for alignment purposes. Also, the intermediate positioning plate 250 has a pair of through-holes 228 on opposing sides thereof each having a diameter smaller than that of the through-hole 221.

The driver unit 203 includes a pair of multilayer piezoelectric elements 214 (e.g., actuators formed of 10 or more piezoelectric layers) arranged parallel to each other and bonded to a substrate 215 with an adhesive, of which only one is shown in the side view. Each piezoelectric element 214 has active portions 214*a* and intermediate passive support portions 214*b* alternating and separate from each other, formed by slitting or die-cutting a piezoelectric material with a dicing saw or through other suitable fabrication processes.

The chamber unit 202 and the driver unit 203 are bonded by an adhesive layer 216 securing upper surfaces of the piezoelectric portions 214*a* and 214*b* to the vibratory plate 213, and the nozzle plate 211, the intermediate positioning plate 250, the channel plate 212, and the vibratory plate 213 in the chamber unit 202 are bonded together with an adhesive applied to an interface between the nozzle plate 211 and the positioning plate 250 and to upper and lower surfaces of the channel plate 212.

In use, the head module 201 is mounted in the printhead P2 with the chamber unit 202 down and the driver unit 203 up so that the nozzle plate 211 faces a recording medium passing below the printhead P2. The chamber unit 202 is supplied with ink from a suitable ink source, not shown, and holds ink in the ink chambers 230 for supplying the corresponding nozzles 240. To print an image, the driver unit 203 selectively drives the active portions 214*a* with electronic pulses, while the support portions 214*b*, remaining non-pulsed, support the chamber unit 202 in place. This causes the active portions 214*a* to pressurize the ink chambers 230, which in turn activate the corresponding nozzles 240 to expel droplets of ink downward onto the recording medium to form an image thereon.

For the printhead P2 to perform printing with good imaging quality, it is important that the printhead P2 have multiple head modules 201 each formed with high dimensional accuracy and properly positioned with respect to each other, forming the nozzle face at a consistent distance close to the recording medium in the print zone. For this purpose, the head module 201 according to this patent specification has its components, particularly the nozzle plate 211, the intermediate positioning plate 250, the channel plate 212, and the vibratory plate 213 forming the chamber unit 202, each machined with extremely high dimensional accuracy, and accurately positioned with respect to each other when assembled into a single unit. In particular, the constituent layers of the chamber unit 202 are positioned relative to each other to an accuracy of ±1 μm or better using a precision alignment technique based on image processing described as follows.

Figure 32:
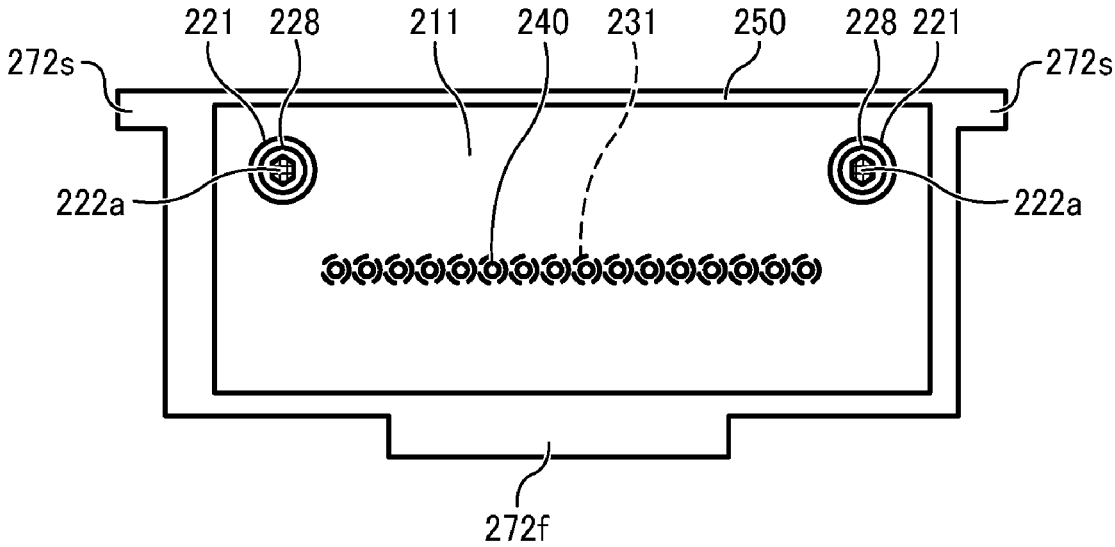
FIG. 32 is a plan view schematically illustrating the nozzle plate aligned with the channel plate and the intermediate positioning plate.

FIG. 32 is a plan view schematically illustrating the nozzle plate 211 aligned with the channel plate 212 and the intermediate positioning plate 250 in the chamber unit 202. As shown in FIG. 32, during assembly, the nozzle plate 211 is placed above the intermediate plate 250 so that the through-holes 228 of the intermediate plate 250 are visible through the through-holes 221 on the upper side of the nozzle plate 211.

With the two plates 211 and 250 thus stacked one atop another, digital image processing is performed using imaging equipment to determine a pair of imaginary reference points, one midway between the through-holes 221 and the other midway between the through-holes 228, as well as a pair of imaginary reference lines, one connecting the through-holes 221 and the other connecting the through-holes 228. The nozzle plate 211 and the intermediate plate 250 are registered relative to each other so as to reduce the distance between the reference points and the angle formed by the reference lines to specified acceptable values. The nozzle plate 211 and the intermediate plate 250 after positioning are forced against each other and bonded together with a suitable temporary bond such as an ultraviolet (UV) curable adhesive.

Instead of positioning and bonding the intermediate plate 250 initially with the nozzle plate 211, alternatively, the assembly procedure may start by positioning and bonding the intermediate plate 250 with the channel plate 212. In such cases, the intermediate plate 250 is placed above the channel plate 212 so that the alignment marks 222*a* of the channel plate 212 are visible through the through-holes 228 on the upper side of the intermediate plate 250.

Subsequently, the plates 211, 250, and 212 are stacked one top another so that the alignment marks 222*a* of the channel plate 212 are visible through the aligned through-holes 228 and 221 on the upper side of the nozzle plate 211. Then, digital image processing is performed to register the channel plate 212 relative to the nozzle plate 211 so as to reduce the displacement between the alignment marks 222*a* and the through-holes 221 in the manner described above, followed by bonding the intermediate plate 250 and the neighboring plate with a suitable temporary bond.

Also, the vibratory plate 213 is stacked on the channel plate 212 so that the alignment marks 222*b* of the channel plate 212 are visible through the through-holes 223 on the upper side of the vibratory plate 213. With the two plates 212 and 213 thus stacked one atop another, digital image processing is performed to register the channel plate 212 relative to the vibratory plate 213 in the manner described above, followed by bonding the plates 212 and 213 with a suitable temporary bond.

After positioning the nozzle plate 211, the intermediate positioning plate 250, the channel plate 212, and the vibratory plate 213 relative to each other, the chamber unit 202 is completed by bonding the constituent layers 211, 250, 212, and 213 with a permanent adhesive.

When obtaining the chamber unit 202 and the driver unit 203, these sub-assemblies are integrated into a head module 201. This involves positioning the chamber unit 202 and the driver unit 203 relative to each other by aligning a pair of through-holes 224 on opposing sides of the vibratory plate 213 with a pair of alignment grooves 217 on recessed portions 218 of the piezoelectric element 214 and subsequently depositing a temporary bond 226 on raised edges 219 of the piezoelectric element 214 for holding the vibratory plate 213 thereto, followed by permanently bonding the chamber unit 202 and the driver unit 203 with the adhesive layer 216 applied between the vibratory plate 213 and the piezoelectric element 214.

Figure 33:
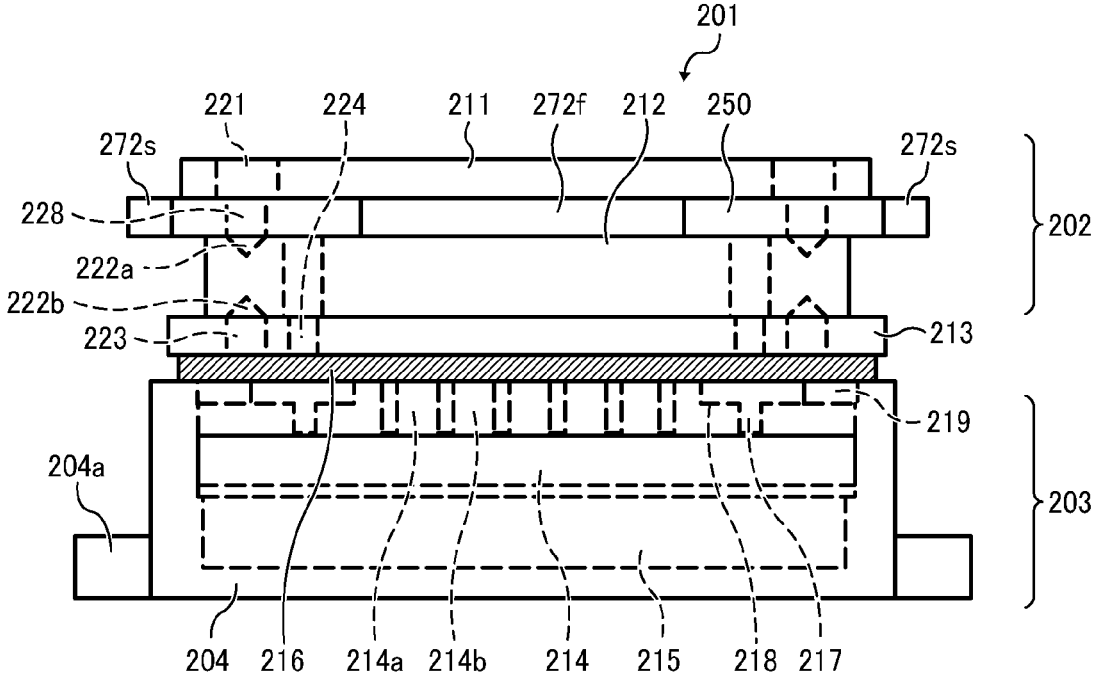
FIG. 33 is a side-elevational view schematically illustrating the head module of FIG. 28 after completion.

Thereafter, the integrated head module 201 is fitted into the frame 204 for completion. Fitting the head module 201 in the frame 204 involves positioning the head module 201 relative to the frame 204, inserting and pressing the driver unit 203 into the frame 204, applying an ultraviolet (UV) curable adhesive to contact surfaces, and curing the adhesive under exposure to UV light. As shown in FIG. 33, which is a side-elevational view schematically illustrating the head module 201 after completion, the frame 204 has a pair of horizontal extensions 4*a* on opposing sides for supporting the head module 201 in place on the printhead P2 as will be described hereinbelow. The head module 201 thus completed with the frame 204 is ready for mounting on the printhead P2.

Although the intermediate positioning plate 250 is used for the single head module 201 in the embodiment depicted above, alternatively, it is also possible that multiple head modules 201 share a single intermediate positioning plate with suitable configurations.

Figure 34:
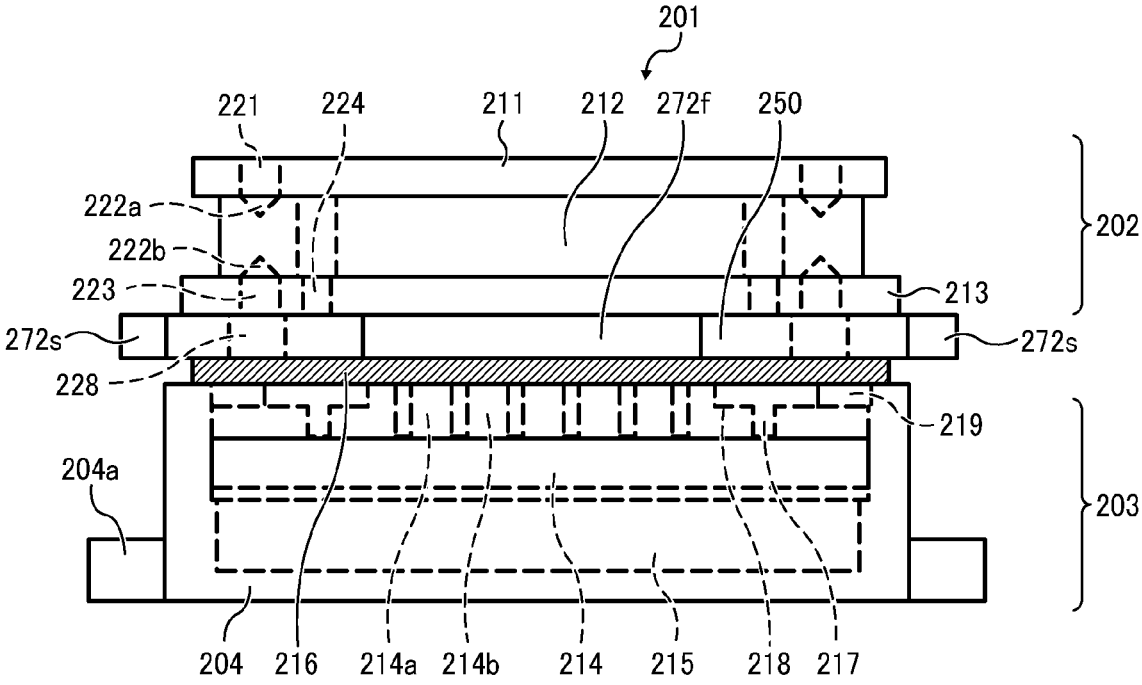
FIG. 34 is a side-elevational view schematically illustrating an alternative embodiment of the head module of FIG. 28 after completion.

Further, although the intermediate positioning plate 250 in the above embodiment lies between the nozzle plate 211 and the channel plate 212, alternatively, it is also possible to insert the positioning plate 250 between the vibratory plate 213 and the driver unit 203 as shown in FIG. 34. In such cases, the intermediate positioning plate 250 is configured to define a common ink chamber, not shown, to distribute ink to the multiple ink chambers 230 instead of the multiple orifices 251. Bonding the vibratory plate 213 and the intermediate plate 250 in such a configuration may occur at any time during the assembly procedure prior to fitting the head assembly 201 into the frame 4 for completion.

Figure 35:
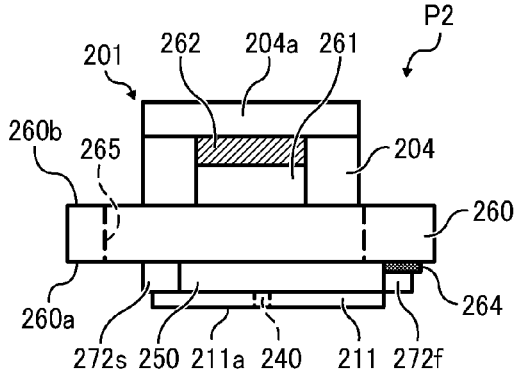
FIGS. 35 through 37 are side-elevational, front elevational, and bottom-plan views, respectively, schematically illustrating the printhead with the head module of FIG. 33 mounted thereon.
Figure 36:
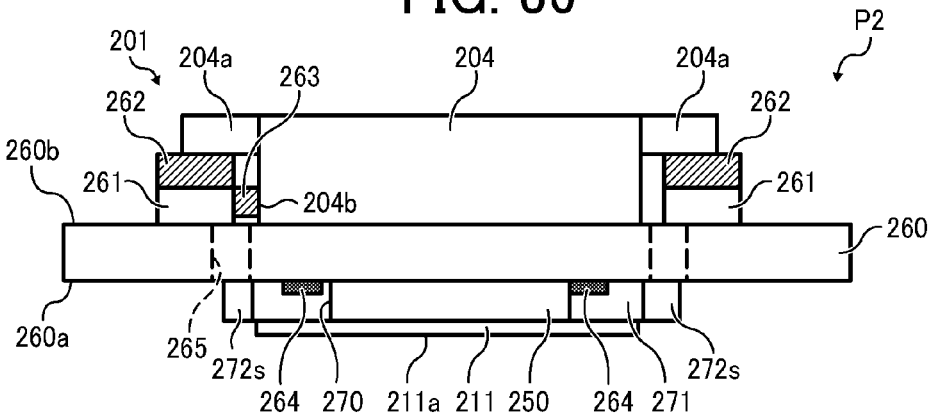
Figure 37:
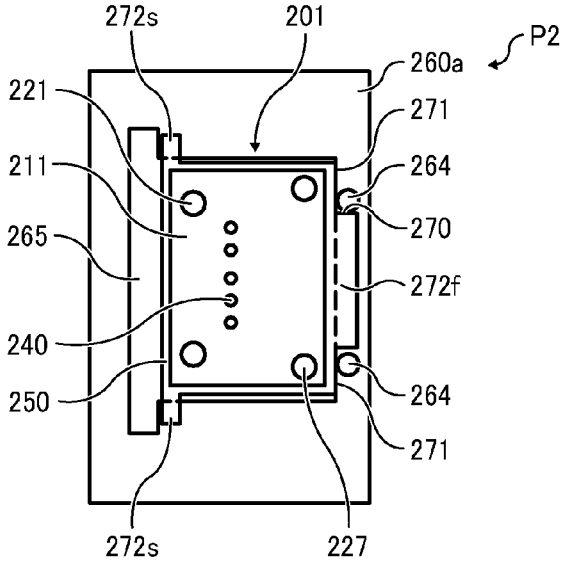

FIGS. 35 through 37 are side-elevational, front elevational, and bottom-plan views, respectively, schematically illustrating the printhead P2 with the head module 201 of FIG. 33 mounted thereon.

As shown in FIGS. 35 through 37, the head module 201 is inserted into a mount base 260 with the nozzle plate 211 down so as to locate a nozzle face 211*a* at the bottom of the printhead assembly P2. The mount base 260 has a bottom positioning surface 260*a* facing downward (i.e., in the direction in which the printhead P2 ejects ink) and a top surface 260*b* opposite the bottom surface 260*a*, holding the head module 201 with an upper surface of the intermediate positioning plate 250 (i.e., the surface opposite the nozzle face 211*a*) contacting the positioning surface 260*a* of the mount base 260.

Specifically, the mount base 260 has an opening 265 shaped to accommodate the lateral dimensions of the intermediate positioning plate 250, a pair of support blocks 261 on the top surface 260*b*, and a pair of reference pins 264 on the bottom surface 260*a* beside a longitudinal edge of the opening 265. The front and side contact ribs 272*f* and 272*s* of the positioning plate 250 contact the positioning surface 260*a* of the mount base 260 around the opening 265, and two perpendicular edges 270 and 271 of the positioning plate 250 contact one of the reference pins 264 of the mount base 260.

Further, the printhead assembly P2 also has a pair of first springs (e.g., leaf springs) 262 disposed between the horizontal extensions 204*a* of the frame 204 and the support blocks 261 of the mount base 260 on both side, and a second spring (e.g., leaf springs) 263 disposed between a side 204*b* of the frame 204 and the support block 261 on the corresponding side. The first springs 262 vertically urging the extensions 204*a* away from the top surface of the base 260 ensure secure contact between the surface of the positioning plate 250 and the bottom surface 260*a* of the mount base 260. Similarly, the second spring 263 laterally urging the side 204*b* of the frame 204 ensures secure contact between the edge 270 of the positioning plate 250 and the reference pin 264 of the mount base 260.

Figure 38:
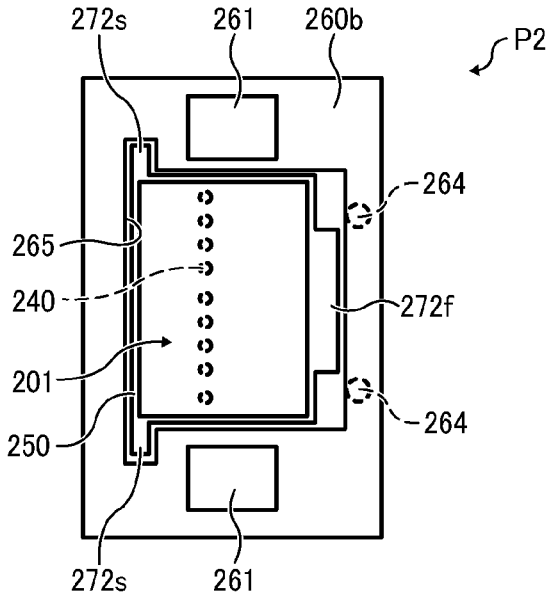
FIGS. 38 and 39 schematically illustrate mounting of the head module of FIG. 33 on a mount base viewed from above.
Figure 39:
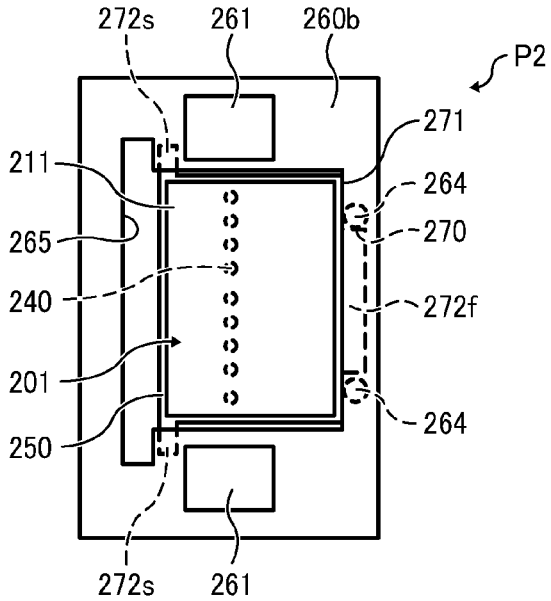

FIGS. 38 and 39 schematically illustrate mounting of the head module 201 on the mount base 260 viewed from above, with components of the head module 201 other than the nozzle plate 211 and the intermediate positioning plate 250 being removed for clarity.

As shown in FIG. 38, the head module 201 is inserted through the opening 265 of the base 260 with the nozzle face 211*a* down until the contact ribs 272 of the positioning plate 250 reach below the bottom surface 260*a* of the base 260. Although not visible in the drawing, at this point, the head module 201 has the horizontal extensions 204*a* of the frame 204 resting on the support blocks 261 of the base 260.

After insertion, the head module 201 is slid sideways until the perpendicular edges 270 and 271 of the positioning plate 250 contact the reference pin 264 as shown in FIG. 39. Then, the first springs 262 are inserted between the extensions 204*a* and the support blocks 261, and the second spring 263 is inserted between the side 204*b* of the frame 204 and the support block 261 on the corresponding side, causing the contact ribs 272*f* and 272*s* to reliably contact the bottom surface 260*a* of the base 260, and the reference edges 170 and 171 to reliably contact the reference pin 64 of the base 260. Subsequently, the extensions 204*a* of the frame 204 are fastened (e.g., with screws) to the corresponding support blocks 261 so as to secure the head module 201 in place, thereby completing the mounting procedure.

Thus, the printhead P2 according to this patent specification has the head module 201 positioned vertically with the contact ribs 272*f* and 272*s* of the intermediate positioning plate 250 contacting the bottom surface 260*a* of the mount base 260, and horizontally with the reference edges 270 and 271 of the intermediate positioning plate 250 contacting the reference pin 264 of the mount base 260.

Moreover, the printhead P2 according to this patent specification is readily assembled and disassembled with the simple positioning mechanism based on the direct contact between the ribbed positioning plate 250 and the mount base 260. In particular, the opening 265 allowing unidirectional insertion of the head module 201 into the mount base 260 enables replacement of each head module 201 without demounting the entire printhead P2, leading to ready maintenance of the image forming apparatus or liquid ejecting device incorporating the modular printhead P2.

In addition, the intermediate positioning plate 250 inserted in the chamber unit 202 reinforces the laminate structure formed of the extremely thin plates.

Although the embodiment described above provides horizontal positioning of the head module 201 by establishing direct contact between the edges 270 and 271 of the intermediate positioning plate 250 and the reference pin 264 of the mount base 260, alternatively, it is also possible to position the head module 201 by engaging a reference pin on the mount base with a corresponding through-hole defined in the intermediate positioning plate 250.

As mentioned, the printhead P2 according to this patent specification is constructed with one or more head modules 201 arranged in a particular configuration according to specific application. The following describes configurations of the printhead P2 with multiple head modules 201 arranged for application to serial and line inkjet printers.

Figure 40:
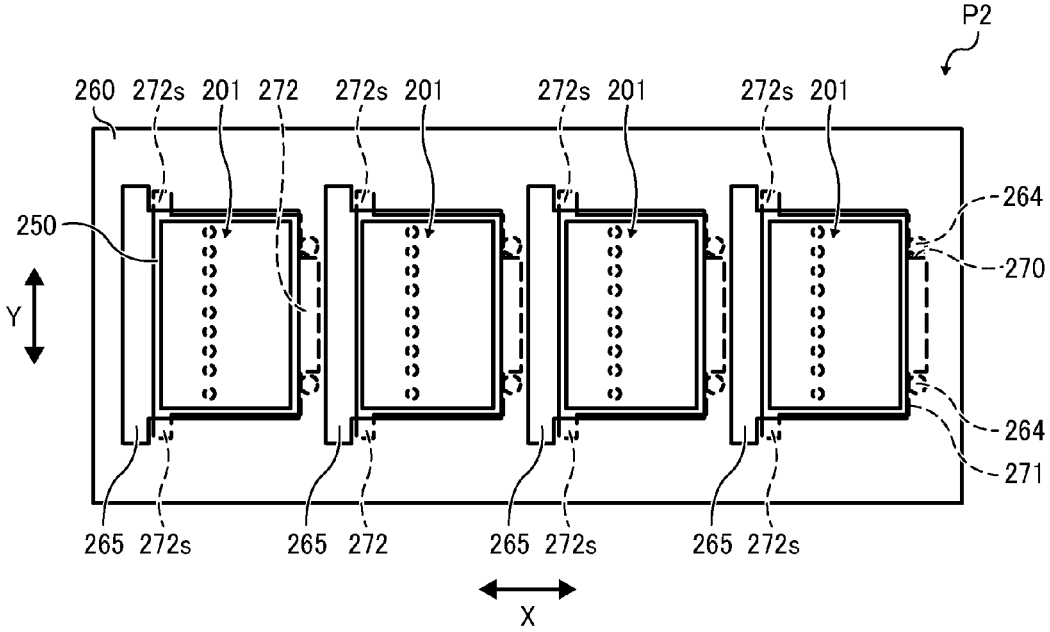
FIG. 40 is a plan view schematically illustrating one configuration of the printhead of FIGS. 35 through 37 for installation in a serial inkjet printer.

FIG. 40 is a plan view schematically illustrating one configuration of the printhead P2 for installation in a serial inkjet printer, taken from above with components of the head modules 201 other than the nozzle plates 211 being removed for clarity.

As shown in FIG. 40, the serial inkjet printhead P2 has multiple (e.g., four in this embodiment) head modules 201 arranged along a main scan direction X perpendicular to a sub-scan direction Y in which a recording medium or sheet moves parallel to the nozzle arrays spanning a given swath in a print zone. Although the illustrated configuration has the multiple nozzle arrays with endmost nozzles aligned with each other in the main scan direction X, the corresponding nozzles of respective arrays may be displaced in the sub-scan direction Y for an application where the printhead P2 is required to eject ink at higher densities.

Figure 41:
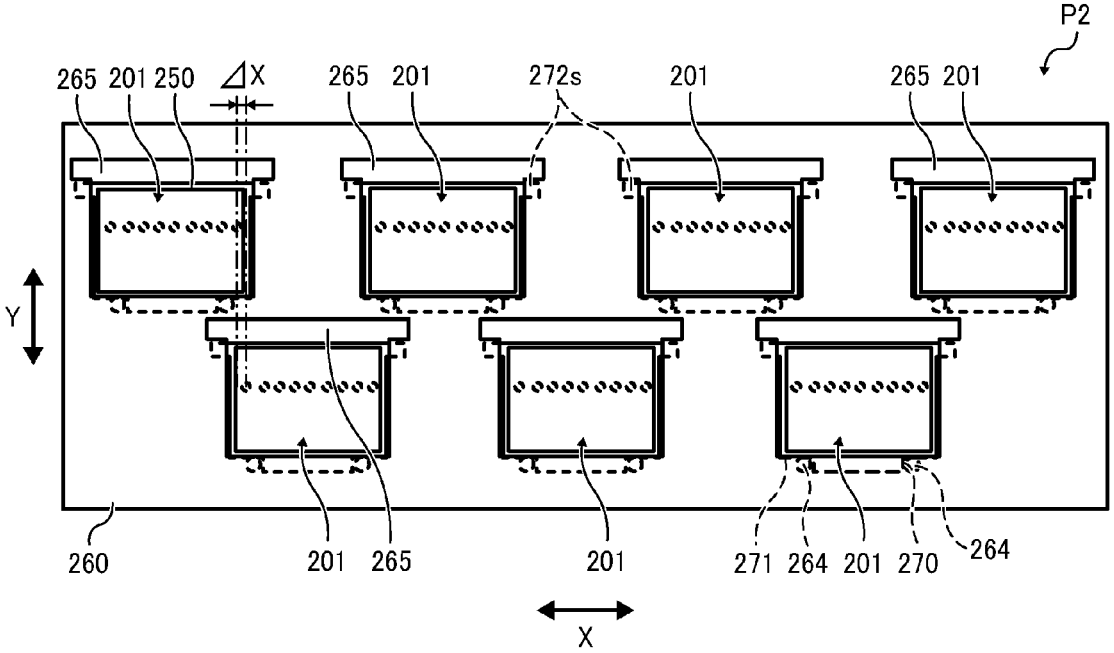
FIG. 41 is a plan view schematically illustrating one configuration of the printhead of FIGS. 35 through 37 for installation in a line inkjet printer.

By contrast, FIG. 41 is a plan view schematically illustrating a printhead P2 for installation in a line inkjet printer, taken from above with components of the head modules 201 other than the nozzle plates 111 being removed for clarity.

As shown in FIG. 41, the line inkjet printhead P2 has multiple (e.g., seven in this embodiment) head modules 201 staggered in two rows each extending along a direction X perpendicular to a sub-scan direction Y in which a recording medium or sheet moves perpendicular to the nozzle arrays spanning the width of a print zone equivalent to the width of a recording sheet. Although the illustrated configuration has the staggered pattern with endmost nozzles of two neighboring nozzle arrays being displaced from each other by a distance $\Delta x$ along the main scan direction X, each nozzle array may partially overlap a neighboring nozzle array for an application where the printhead P1 is required to eject ink at higher densities.

In both configurations described in FIGS. 40 and 41, the multiple head modules 201 included in the printhead P2 are aligned relative to each other not only in the horizontal directions X and Y but also in a vertical direction perpendicular to the XY plane, since each head module 201 is accurately positioned horizontally with the edges 270 and 271 of the intermediate positioning plate 250 contacting the reference pin 264, and vertically with the ribs 272 of the intermediate positioning plate 250 contacting the mount base surface 260*a*. This effects a proper alignment of multiple nozzle arrays in the horizontal directions, and a constant gap between the nozzles and the recording medium in the print zone, resulting in high printing performance of the modular inkjet printhead P2 according to this patent specification.

Although the embodiments depicted above illustrate configurations of the printhead P using one or more piezoelectric head modules, the positioning mechanism included in the printhead P according to this patent specification may be applicable to any type of liquid ejecting head, such as one driven with a thermal actuator, an electrostatic actuator, or the like, insofar as the chamber unit is laminated with a nozzle plate and/or a channel plate allowing liquid to flow therethrough.

Figure 42:
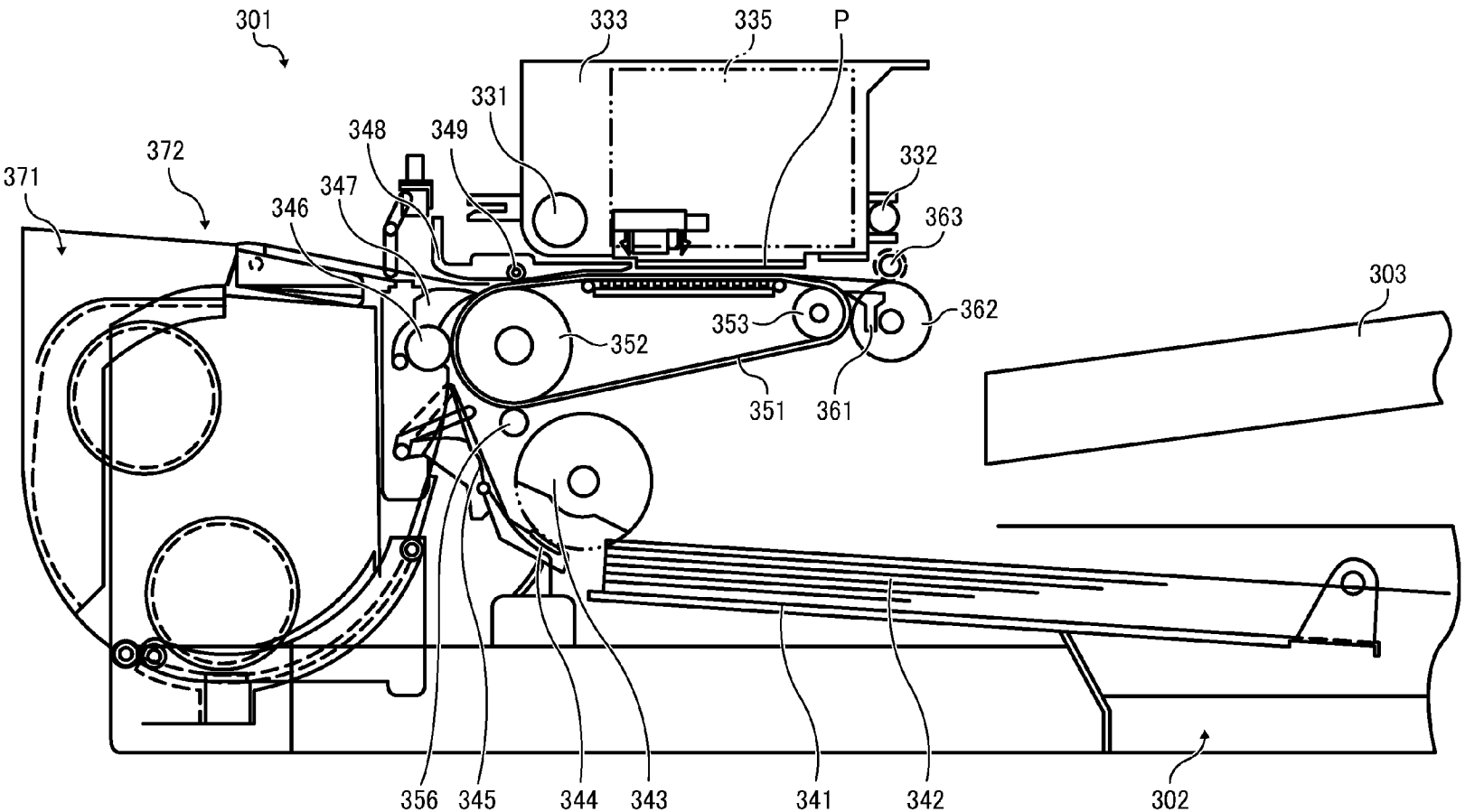
FIGS. 42 and 43 are side and partial top views, respectively, schematically illustrating an image forming apparatus incorporating the printhead according to this patent specification.
Figure 43:
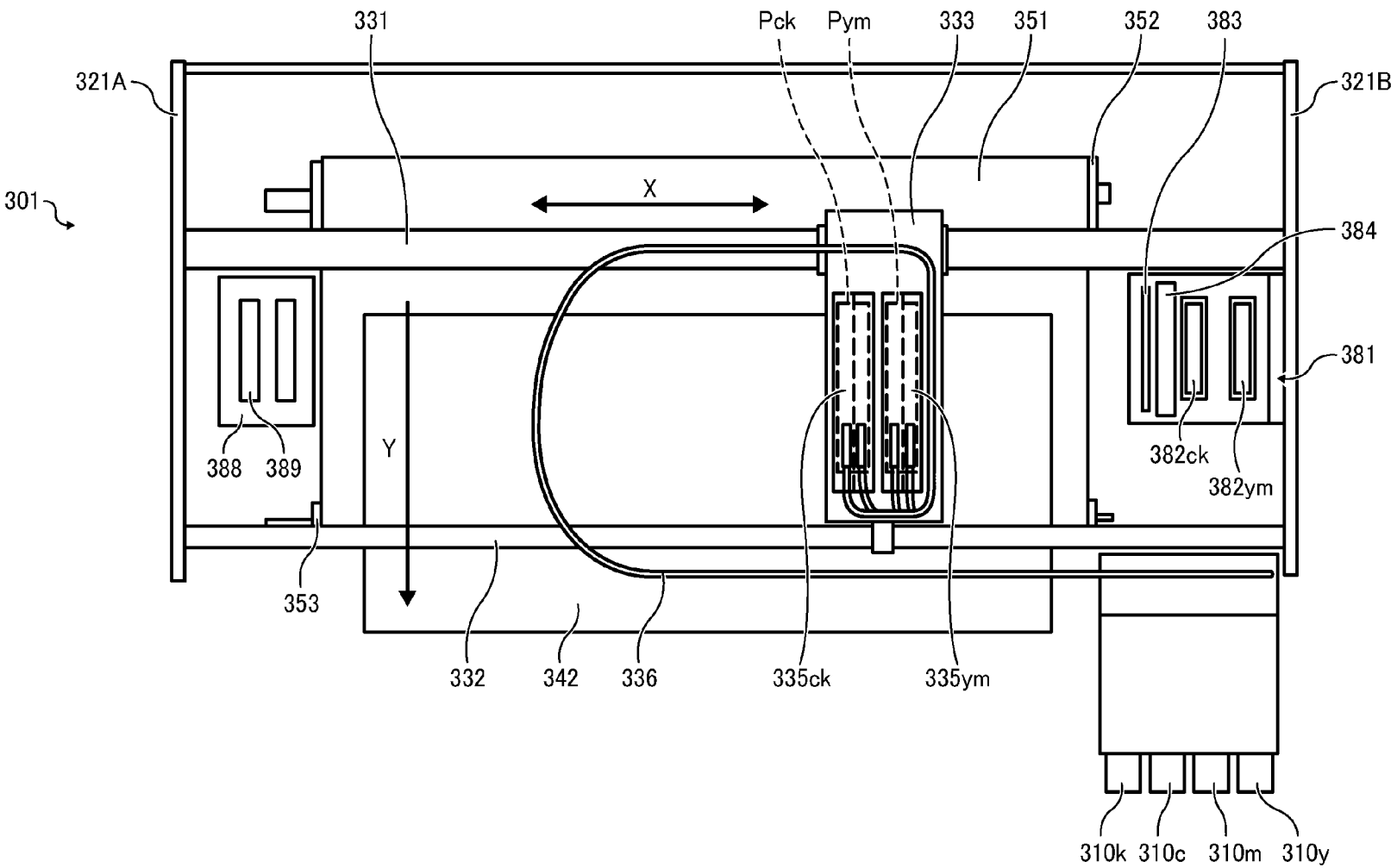

FIGS. 42 and 43 are side and partial top views, respectively, schematically illustrating an image forming apparatus 301 incorporating the printhead P according to this patent specification.

As shown in FIG. 42, the image forming apparatus 301 is a serial inkjet printer with an upper printer section printing images on recording media or sheets fed from a lower sheet feeder section.

In the image forming apparatus 301, the sheet feeder section includes a sheet tray 302 to hold a stack of recording sheets 342 on a bottom board 341, from which each sheet 342 is fed with a pickup roller 343 and a separator pad 344 formed of high friction material and pressed against the pickup roller 343. The sheet feeder section also includes a guide plate 345, a counter roller 346, an edge guide 347, and a roller assembly 348 having a pressure roller 349 embedded therein, which together form a feed path along which each recording sheet 342 travels upward to the printing section.

The sheet feed path defined by the guide members leads to an endless transport belt 351 on which the fed sheet 342 passes beneath the printing section during printing. The transport belt 351 is supported around a motor-driven conveyor roller 352 and a tension roller 353, with its outer surface in contact with a charge roller 356. As the conveyor roller 352 rotates clockwise in the drawing, the transport belt 351 rotates in the same direction together with the adjoining rollers 353 and 356.

At one side of the transport belt 351 is an output unit, formed of a sheet separator 361, an ejection roller 362, and a spur 363, leading to an output tray 303 on a front end of the apparatus 301. At the opposite side of the transport belt 351 is a sheet reversing unit 371 topped with a manual feed tray 372 and releasably mounted on a back end of the apparatus 301.

With additional reference to FIG. 43, the printer section includes a carriage 333 supported by a pair of opposed parallel guide rods 331 and 332 extending between side walls 321A and 321B of the apparatus 301 to define a print zone above the transport belt 351. In the print zone, the carriage 333 is moved reciprocally back and forth in a main scan direction X with a motor-driven timing belt, not shown, and the transport belt 351 runs in a sub-scan direction Y orthogonal to the main scan direction X with the motor-driven conveyor roller 352.

The carriage 333 contains printheads Pym and Pck (indicated collectively by reference letter P) according to this patent specification combined with multiple ink containers or subtanks 335*ym* and 335*ck* (indicated collectively by numeral 335) disposed atop the printheads P. The printheads Pym and Pck each has a nozzle face with multiple nozzles, not shown, arranged parallel to the sub-scan direction Y in a manner similar to that depicted in FIG. 13, 26, or 40. Specifically, the printhead Pym includes a set of two nozzle arrays, one for yellow ink and the other for magenta ink, in fluid communication with the subtank 335*ym*, and the printhead Pck includes another set of two nozzle arrays, one for cyan ink and the other for black ink, in fluid communication with the subtank 335*ck*. Alternatively, instead of separate nozzle faces each having a set of nozzle arrays for two colors of ink, a single integral nozzle face having nozzle arrays for all the four colors of ink may also be used as the inkjet printhead.

The subtanks 335 serve to hold ink for immediate supply to the printheads P as needed during printing, each connected to a corresponding one of ink cartridges or main tanks 310*y*, 310*m*, 310*c*, and 310*k* from which ink is supplied via a supply tube 236.

In addition, the printer section includes a maintenance station 381 with nozzle caps 382*ym* and 382*ck*, a wiper blade 383, and a first spittoon 384 all located at one side of the print zone. As well, a second spittoon 388 with elongated openings 389 parallel to the nozzle arrays of the printheads P is disposed at the opposite side of the print zone.

The maintenance station 381 performs various maintenance/recovery operations to maintain the nozzles in proper condition and ensure reliable performance of the printhead P. Such operations include sucking nozzles clear with the nozzle caps 382*ck* and 382*ym*, wiping the nozzle faces with the wiper blade 383, firing the nozzles to discharge dried viscous ink into the first spittoon 384 as the printer idles and into the second spittoon 388 during printing, removing ink residue accumulated on the wiper blade 383, etc.

During operation, the sheet feeder section first feeds the recording sheets 342 one by one with the pickup roller 343 and the separator pad 344. Each fed sheet 342 is substantially vertically oriented, and enters an entrance nip defined as where the sheet is gripped between the counter roller 346 and the conveyor roller 352, guided along the guide plate 345.

Rotating in contact with the charge roller 356, the transport belt 351 develops positively and negatively charged areas of uniform size alternately appearing along the length of its outer surface. This recurring pattern of electric charges is created by applying an alternating voltage, i.e., a voltage with polarity switching between negative and positive over time, to the charge roller 356 which rotates upon rotation of the transport belt 351.

The recording sheet 342 reaching the entrance nip is attracted to the charged surface of the transport belt 351 with a leading edge thereof guided by the edge guide 347 and pressed against the belt surface by the roller assembly 348. As the transport belt 351 rotates, the recording sheet 342 is turned substantially 90 degrees and forwarded to the printer section in a substantially flat position.

In the printer section, the carriage 333 traverses the print zone in the main scan direction X in a reciprocating motion as the printheads P selectively activate their nozzles according to image data, while the transport belt 351 conveys the recording sheet 342 beneath the printheads P in the sub-scan direction Y in a stepped motion. Moving from one side to the other of the print zone, the printheads P eject ink droplets across the recording sheet 342 while the transport belt 351 is at rest. When one swath of ink image is created, the transport belt 351 advances the recording sheet 342 by a given amount and stops. The printhead P then forms another swath of ink image in a succeeding portion of the recording sheet 342 by moving back to the side from which it came. Such a process is repeated until an end signal is transmitted and/or until a trailing end of the sheet 342 reaches the print zone.

When duplex printing is intended, the transport belt 351 rotates in the opposite direction to introduce the recording sheet 342 into the sheet reversing unit 371. The sheet reversing unit 371 turns over the incoming sheet 342 for re-feeding to the entrance nip, and the same process is repeated to print an ink image on the reverse side of the recording sheet 342.

After printing, the recording sheet 342 bearing an ink image thereon advances to the output unit, stripped from the transport belt 351 by the sheet separator 361, and ejected by the ejection roller 362 and the spur 363 downward to the output tray 303.

Figure 44:
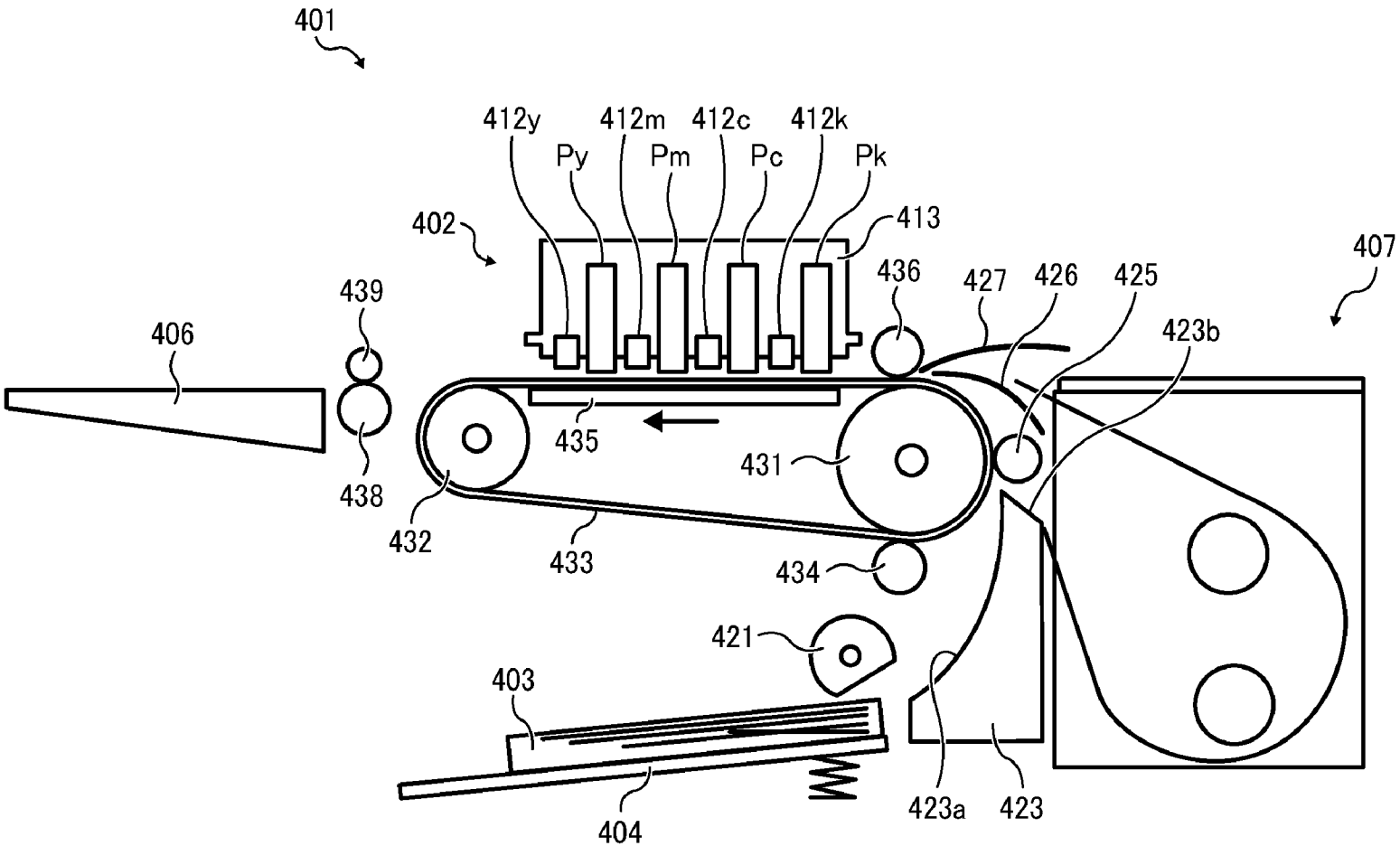
FIG. 44 schematically illustrates another image forming apparatus incorporating the printhead according to this patent specification.

FIG. 44 schematically illustrates another image forming apparatus 401 incorporating the printhead P according to this patent specification.

As shown in FIG. 44, the image forming apparatus 401 is a line inkjet printer with an upper printer section printing images on recording media or sheets fed from a lower sheet feeder section.

In the image forming apparatus 401, the sheet feeder section includes a sheet tray 404 holding a stack of recording sheets 403, as well as a pickup roller 421, a separator pad, not shown, a sheet guide 423, a registration roller 425, guide plates 426 and 427, defining a sheet feed path along which each recording sheet 403 travels toward an endless transport belt 433. The transport belt 433 is entrained around a drive roller 431 and a driven roller 432 and equipped with a charge roller 434, a support platen 435, a pressure roller 436, and a cleaning roller, etc. Also included are a sheet reversing unit 407 releasably mounted on the apparatus 401 upstream of the transport belt 433 and an ejection roller 438 and a spur 439 to lead the recording sheet to an output tray 406 downstream of the transport belt 433.

The printer section includes page-width printheads Py, Pm, Pc, and Pk for four primary colors of ink (i.e., yellow, magenta, cyan, and black) employed in the image forming apparatus 400, all mounted on a head holder 413 with the nozzle face down toward the print zone.

Each printhead P has one or more nozzle arrays arranged in a manner similar to that depicted in FIG. 14, 27, or 41, and may be either integral with or independent of a replaceable ink tank or ink cartridge from which ink is supplied to the chamber unit. Further, although the present embodiment illustrates the four printheads P arranged in a particular sequence (i.e., black, cyan, magenta, and yellow from upstream to downstream the printer section), the colors of ink as well as the number and sequence of printheads employed may be other than those illustrated in this embodiment.

In addition, each printhead P is equipped with a maintenance device 412 that can purge and/or wipe the nozzle face with a suction cap and other cleaning mechanism. When maintenance is intended, the printhead P and the maintenance device 412 move relative to each other to apply the face cleaner to the nozzle face.

During operation, the feed roller 421 and the separator pad feed the recording sheets 403 one by one to the sheet feed path, and each fed sheet 403 travels along a curved surface 423*a* of the sheet guide 423 upward into a registration nip defined between the registration roller 425 and the transport belt 433, and stops for a given period of time.

The transport belt 433 rotates counterclockwise in the drawing in contact with the charge roller 434 to which is applied a voltage of high amplitude and polarity switching between positive and negative at a given interval. This imparts charges to the surface of the rotating belt 433, developing a reciprocating pattern of positively and negatively charged areas on the belt surface.

Then, the registration roller 425 starts rotation to forward the sheet 403 onto the charged surface of the transport belt 433, causing electric polarization within the sheet 403 in which charges of a polarity opposite to that of the charged belt surface are induced on a surface of the sheet 403 in contact with the belt 433. This results in electrostatic attraction between the charges on the belt surface and the sheet surface in contact with each other, holding the recording sheet 403 onto the moving transport belt 433. Such electrostatic attraction between the belt and sheet surfaces is sufficiently high to correct warps and ripples of the recording sheet 403, effectively flattening out the sheet 403 entering a print zone defined between the printheads 1 and the transport belt 433.

In the printer section, a multicolor image is formed by ejecting droplets of ink sequentially from the black, cyan, magenta, and yellow inkjet printheads Pk, Pc, Pm, and Py, onto the recording sheet 403 passing through the print zone.

When duplex printing is intended, the transport belt 433 rotates clockwise in the drawing to introduce the recording sheet 403 along the guide plate 427 into the sheet reversing unit 407, which re-feeds the incoming sheet 403 with the printed face down along a surface 423*b* of the sheet guide 423. The inverted sheet 423 then enters the registration nip, and the printing process described above is repeated to print an image on the reverse side of the recording sheet 423.

After printing, the recording sheet 423 leaves the surface of the transport belt 433 and reaches the ejection roller 438, which outputs the incoming sheet 423 to the output tray 406 for user pickup.

Thus, the inkjet printhead P according to this patent specification is incorporated in an inkjet printer that forms images by ejecting droplets of ink from multiple nozzles onto recording media passing below the printhead. The inkjet printer incorporating the printhead P, be it a serial type or a full-line type, provides good printing quality owing to good alignment between multiple head modules ejecting ink droplets and consistently narrow gap between the head module and the recording medium.

Although the embodiments above describe the image forming apparatus as a simple inkjet printer, the inkjet printhead P according to this patent specification may be incorporated in a multifunctional machine with multiple image forming capabilities, such as faxing and copying in addition to printing, as well as in any liquid ejecting device consisting of a liquid ejecting head and circuitry driving the liquid ejector. Further, the inkjet printhead P according to this patent specification is applicable to any image forming apparatus that handles a liquid material for image formation, such as a fixing agent or a marking agent other than ink in the narrow sense of the word. In any such mechanism, the inkjet printhead P according to this patent specification provides good imaging quality owing to good alignment between multiple head modules ejecting liquid droplets and consistently narrow gap between the head module and recording media.

Numerous additional modifications and variations are possible in light of the above teachings. It is therefore to be understood that, within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An inkjet printhead, comprising:

multiple head modules each including a laminate unit containing a nozzle to eject ink in droplets and an ink chamber in fluid communication with the nozzle; and a mount base to mount the multiple head modules thereon, the mount base defining a first contact surface facing a first direction in which the ink is ejected, each laminate unit defining a second contact surface facing a second direction opposite to the first direction, the first and second contact surfaces held in contact with each other to position each head module in the mount base.

2. The inkjet printhead according to claim 1, wherein the second contact surface comprises a nozzle plate defining the nozzle in the laminate unit.

3. The inkjet printhead according to claim 1, wherein the second contact surface comprises a channel plate defining the ink chamber in the laminate unit.

4. The inkjet printhead according to claim 1, wherein the mount base includes a reference pin on the first contact surface, and the laminate unit includes a positioning portion corresponding to the reference pin, the reference pin and the positioning portion held in contact with each other to position the head module in place on the first contact surface.

5. The inkjet printhead according to claim 4, wherein the positioning portion comprises an edge of a nozzle plate defining the nozzle in the laminate unit.

6. The inkjet printhead according to claim 1, wherein the mount base includes an opening to accommodate the head module, through which the head module is unidirectionally inserted into the mount base during mounting.

7. The inkjet printhead according to claim 1, wherein the second contact surface has a rib that contacts the first contact surface.

8. An image forming apparatus incorporating the inkjet printhead according to claim 1.

* * * * *